US007950165B2

(12) United States Patent
Hall

(10) Patent No.: US 7,950,165 B2
(45) Date of Patent: May 31, 2011

(54) ALIGNMENT APPARATUS

(76) Inventor: Arthur Hall, Doncaster (GB)

( * ) Notice: Subject to any disclaimer, the term of this patent is extended or adjusted under 35 U.S.C. 154(b) by 0 days.

(21) Appl. No.: 12/597,489

(22) PCT Filed: Jan. 30, 2008

(86) PCT No.: PCT/GB2008/000301

§ 371 (c)(1),
(2), (4) Date: Mar. 2, 2010

(87) PCT Pub. No.: WO2008/132421

PCT Pub. Date: Nov. 6, 2008

(65) Prior Publication Data

US 2010/0154236 A1 Jun. 24, 2010

(30) Foreign Application Priority Data

Apr. 27, 2007 (GB) ..... 0708145.8

(51) Int. Cl.
*G01B 5/16* (2006.01)
*G01B 3/00* (2006.01)
*E04F 13/08* (2006.01)

(52) U.S. Cl. ..... 33/613; 33/527; 52/387; 52/747.11

(58) Field of Classification Search ..... 33/613, 33/526, 527, 1 G; 52/387, 747.11; 428/120
See application file for complete search history.

(56) References Cited

U.S. PATENT DOCUMENTS

| | | | | | |
|---|---|---|---|---|---|
| 2,852,932 | A * | 9/1958 | Cable | 52/385 |
| 3,254,417 | A * | 6/1966 | Carmichael, Sr. | 33/526 |
| 3,775,856 | A * | 12/1973 | Schmidt | 33/526 |
| 4,712,309 | A * | 12/1987 | Kingston et al. | 33/527 |
| 4,744,194 | A * | 5/1988 | Yasuyoshi | 52/747.11 |
| 4,761,926 | A * | 8/1988 | Rea et al. | 52/387 |
| 5,418,036 | A * | 5/1995 | Tokikawa et al. | 428/120 |
| 5,447,004 | A * | 9/1995 | Vrnak | 52/387 |
| 5,616,376 | A * | 4/1997 | Lockshaw et al. | 428/33 |
| 5,832,619 | A * | 11/1998 | Volkema, Jr. | 33/527 |
| 6,990,777 | B2 * | 1/2006 | Poliacek et al. | 52/384 |
| 7,748,132 | B1 * | 7/2010 | Engala | 33/527 |
| 2006/0053741 | A1 * | 3/2006 | Poliacek et al. | 52/747.11 |

* cited by examiner

*Primary Examiner* — Christopher W Fulton
(74) *Attorney, Agent, or Firm* — patenttm.us

(57) ABSTRACT

An alignment apparatus (10) comprises a plurality of first members (12) and a plurality of second members (14). First and second co-operating formations (16, 22) are provided on the first and second members. The co-operating formations can co-operate with one another to secure the first members to the second members. The first members include spaced alignment formations arranged to align the placement of articles on the surface. The first co-operating formations may constitute the alignment formations.

18 Claims, 23 Drawing Sheets

ALIGNMENT APPARATUS

This invention relates to alignment apparatus. More particularly, but not exclusively, this invention relates to alignment apparatus to assist people in laying floor, ceiling or wall tiles, or slabs, such as paving slabs. Embodiments of this invention relate to tiling guides or to paving guides.

When tiling a surface, such as a wall, a ceiling or a floor, or when laying paving slabs, the tiles or slabs are simply arranged upon the surface and fixed thereto using an appropriate adhesive. Judgment and skill are required in order to ensure that the tiles are laid in the most aesthetically pleasing manner on the surface.

According to one aspect of this invention, there is provided an alignment apparatus comprising a plurality of alignment members, a plurality of co-operating formations co-operable with one another to secure the alignment members to one another, and alignment formations associated with the alignment members to align the placement of articles on the surface. The alignment members may be elongate.

According to another aspect of this invention, there is provided an alignment apparatus comprising a plurality of alignment members, and a plurality of first and second co-operating formations, the first and second co-operating formations being configured to co-operate with one another to secure the alignment members to one another, wherein the first co-operating formations comprise article alignment formations arranged to align the placement of the articles on a surface.

The second co-operating formations may be provided on or in the alignment members, and may be spaced along the alignment members.

In a first embodiment, the plurality of alignment members may comprise a plurality of first alignment members, and may also comprise a plurality of second alignment members. The co-operating formations may comprise first co-operating formations on the first alignment members, and second co-operating formations on the second alignment members.

The co-operating formations may be arranged on the first and second alignment members so that the second alignment members overlie the first alignment members. This provides the advantage in the embodiments described herein that the alignment apparatus forms a grid providing spaces in which the articles can be placed.

In this arrangement, the first alignment members may be secured transverse to the second alignment members. The co-operating formations may be so arranged that the first and second alignment members extend substantially orthogonally to one another.

The first co-operating formations may constitute the aforesaid alignment formations.

In a second embodiment, the first co-operating formations may be separate from the alignment members. The second co-operating formations may be configured such that the alignment members can overlie one another with the second co-operating formations of some of the alignment members being aligned with the second co-operating formations of others of the alignment members.

In the second embodiment, the first co-operating formations may co-operate with the aligned second co-operating formations of the overlying alignment members to secure the overlying alignment members to one another.

Each first co-operating formation may comprise a projection, and each second co-operating formation may comprise an aperture or recess. Each first co-operating formation may comprise a cruciform member.

Each second co-operating formation may comprise a cruciform aperture or recess, which may be provided on or in at least some of the alignment members.

In the second embodiment, each first co-operating formation may comprise a plug member, which may comprise a base portion and the projection. The projection may extend from the base portion.

In this embodiment, the projection may be configured to be inserted through aligned second co-operating formations of overlying alignment members to secure the alignment members to one another.

In the first embodiment, the first alignment members may be provided with a plurality of the first co-operating formations spaced from one another, and the second alignment members may be provided with a plurality of the second co-operating formations spaced from one another.

The second co-operating formations may be spaced from one another by distances that correspond to the lengths of the sides of different sized tiles. Thus, the second embodiment provides an advantage that the user can select at which of the second alignment formations the alignment members overlie one another.

By doing this, the distance between adjacent substantially parallel alignment members is selected so that it is substantially equal to the length of the side of the tile to be arranged on the surface.

Each alignment member may comprise a single second co-operating formation adjacent one end region thereof. Each alignment member may comprise a plurality of sets of second co-operating formations spaced from each other along the alignment member.

Each set of second co-operating formations may comprise a plurality of second co-operating formations. The distance between the second co-operating formations may progressively increase in successive sets along the alignment member.

The alignment apparatus may comprise a tiling guide and/or a paving guide.

The alignment members may be elongate and may comprise substantially flat strips. In one embodiment, the first and second co-operating formations may be spaced along the first and second alignment members.

The first and second alignment members may be capable of being arranged in an interlocking grid, with the first and second co-operating formations co-operating with one another to secure the first and second alignment members to one another.

In the first embodiment, the first co-operating formations may each comprise a projection projecting from the respective first alignment member. The first co-operating formations may comprise corner receiving elements arranged to receive a corner region of a tile.

Each first co-operating formation may comprise a plurality of outwardly extending arms. In one embodiment, each first co-operating formation may comprise a cruciform member.

The arms of each first co-operating formation may be substantially the same as each other. Each first co-operating formation may be a right angled cruciform member to receive corresponding corner regions of the tiles.

Each second co-operating formation may be the form of an aperture in the, or in the second, alignment members. Each aperture may have a plurality of outwardly extending arms.

In one embodiment, each second co-operating formation may be in the form of a cruciform aperture. The arms of each second co-operating formation may be substantially the same as each other.

Each second co-operating formation may be a right angled cruciform aperture which may define right angled corners between adjacent arms of the cruciform aperture. In the first embodiment, the cruciform aperture can desirably receive a respective first co-operating formation and secure the first and second alignment members to each other.

In a further embodiment, the second co-operating formations may comprise an upstanding member defining a recess therein to receive the first co-operating formation. Each second co-operating formation may comprise a cruciform member defining the recess therein.

The recess may be a cruciform recess, and may define right angled corners between the arms of the cruciform recess. In the further embodiment, the cruciform recess can desirably receive a respective first co-operating formation and secure the first and second alignment members to each other.

The first co-operating formations may be spaced from each other at a first predetermined distance. The first predetermined distance is preferably substantially equal to the length of an edge of an article to be aligned by the alignment apparatus.

Adjacent second co-operating formations may be spaced from each other at a second predetermined distance. The second predetermined distance is preferably substantially equal to the length of an edge of a tile to be aligned by the alignment apparatus.

In the first embodiment, first and second connecting formations may be provided at the opposite end regions of the first and second alignment members. In the first embodiment, the provision of the first and second connecting formations allows the area covered by the alignment apparatus to be extended.

The first connecting formations may be provided on the first alignment member. One of the first connecting formations may be provided at each respective opposite end region of the first alignment member.

In the first embodiment, the second connecting formations may be provided on the second alignment member. One of the second connecting formations may be provided at each respective opposite end region of the second alignment member.

In the second embodiment, the first connecting formations may be separate from the alignment members. In the second embodiment, each alignment member is provided with a respective second connecting formation at each end region of the alignment member.

The distance between the connecting formations and the adjacent respective first or second co-operating formation is substantially half of the distance between adjacent respective first or second co-operating formations.

Each first connecting formation may comprise a connecting projection. Each connecting projection may be elongate. Each second connecting formation may comprise an aperture or recess to receive the connecting projection.

Each aperture may be elongate, and conveniently, in the form of a slot to receive the elongate connecting projection. In the further embodiment, each second connecting formation may comprise a projection defining a recess. The recess of the further embodiment may be elongate.

In the second embodiment, each first connecting formation may comprise a plug element, which comprises a base part and the connecting projection on the base part. The connecting projection may extend from the base part.

The connecting projection may be configured to be inserted through aligned second connecting formations of overlying alignment members to secure the alignment members to one another. The connecting projection may be elongate.

In a further embodiment, the elongate first member may comprise an elongate main part and a plurality of support formations to support the first co-operating formations.

The support formations may be provided on the main part, and may be spaced along the main part. The support formations may be substantially uniformly spaced along the main part.

The support formations may extend outwardly from the main part, and may lie in the same plane as the main part. Each support portion may have a generally oval shape.

Each first co-operating formation may be provided with a detent member thereon, to hold the second member on the first member. Where the first co-operating formation comprises a plurality of arms, the detent member may be provided on at least one of the arms. Each of the arms may be provided with a respective detent member.

Each detent member may comprise an outwardly extending projection, which may be hemispherical.

The second alignment member may comprise an elongate main portion and a plurality of receiving formations to receive the first co-operating formations. The receiving formations may be provided on the main portion and may be spaced along the main portion. The receiving formations may be substantially uniformly spaced along the main portion.

The receiving portions may extend outwardly from the main portion, and may lie in the same plane as the main portion. Each receiving portion may have a generally oval shape.

The receiving portions may define the second co-operating formations.

The alignment apparatus may further comprise a plurality of sizing accommodation members to accommodate different sized articles. The sizing accommodation members may comprise sleeves configured to fit over the first co-operating formations.

According to another aspect of this invention, there is provided a method of applying a plurality of articles to a surface, the method comprising arranging an alignment apparatus as described above in an interlocking grid arrangement, such that the first and second co-operating formations cooperate with each other secure the alignment members to each other, and the first and second co-operating formations define article receiving regions, each article receiving region being configured to receive a respective article, wherein the method further includes arranging the alignment apparatus on the surface, and disposing articles in the aforesaid regions in register with the first co-operating formations.

In one embodiment, the method may comprise a method for tiling or paving a surface.

The method may comprise connecting further alignment members to the aforementioned alignment members. In a first embodiment, the method may comprise connecting further first alignment members to the aforementioned first alignment members.

The method may comprise connecting further second alignment members to the aforementioned second alignment members.

Embodiments of the invention will now be described by way of example only, with reference the accompanying drawings, in which.

Figure 1:
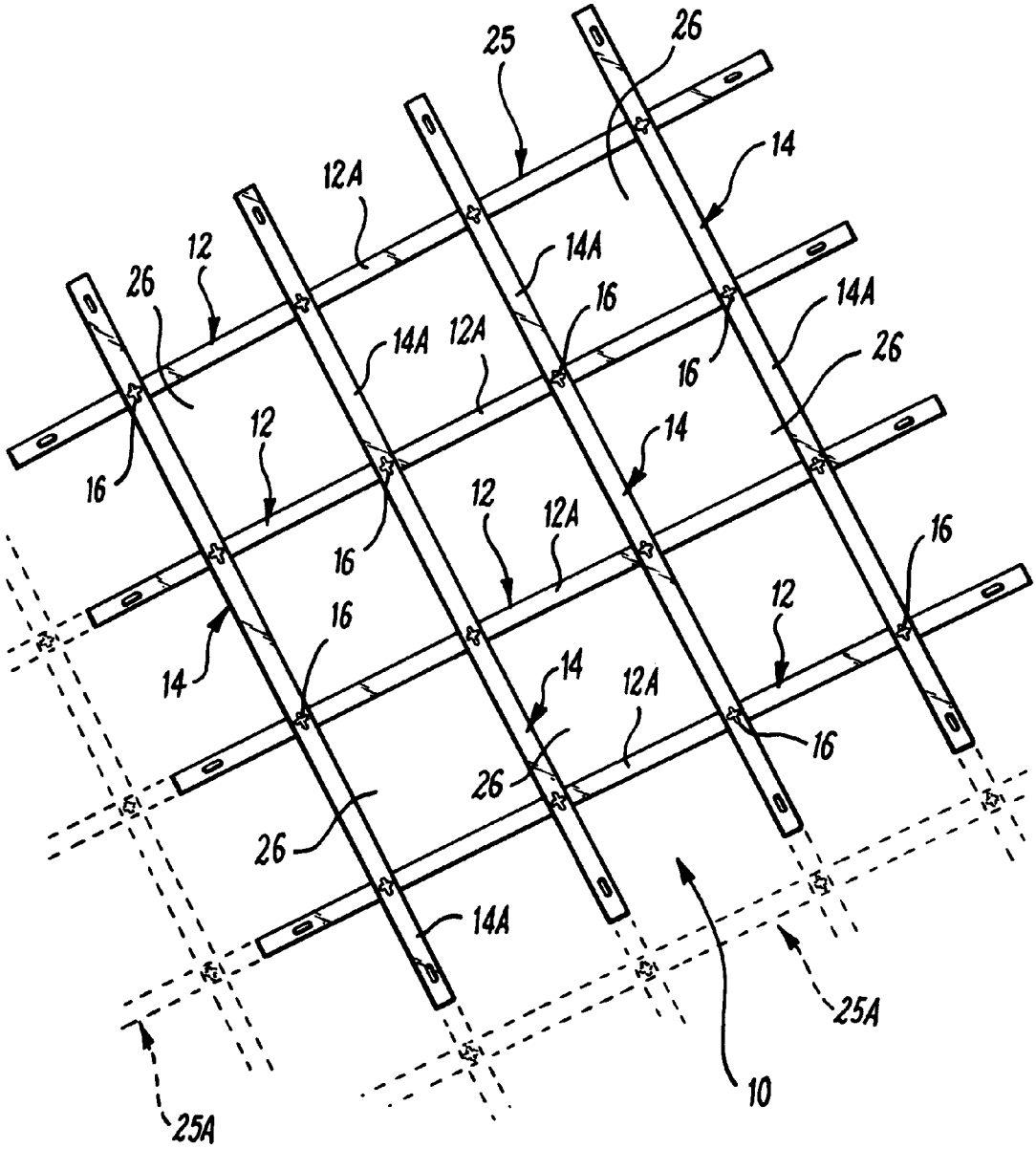
FIG. 1 is a top view of an alignment apparatus.

Referring to the drawings, an alignment apparatus 10, in the form of a tiling guide, is shown. The alignment apparatus comprises a plurality of first alignment members 12 and a plurality of second alignment members 14.

Each of the first and second alignment members 12, 14 is in the form of an elongate substantially flat strip formed of a suitable material, such as a plastics material. A suitable plastics material may be, for example, polypropylene.

The first and second alignment members 12, 14 have opposite elongate generally flat upper and lower opposite faces 12A, 12B and 14A, 14B.

Figure 2:
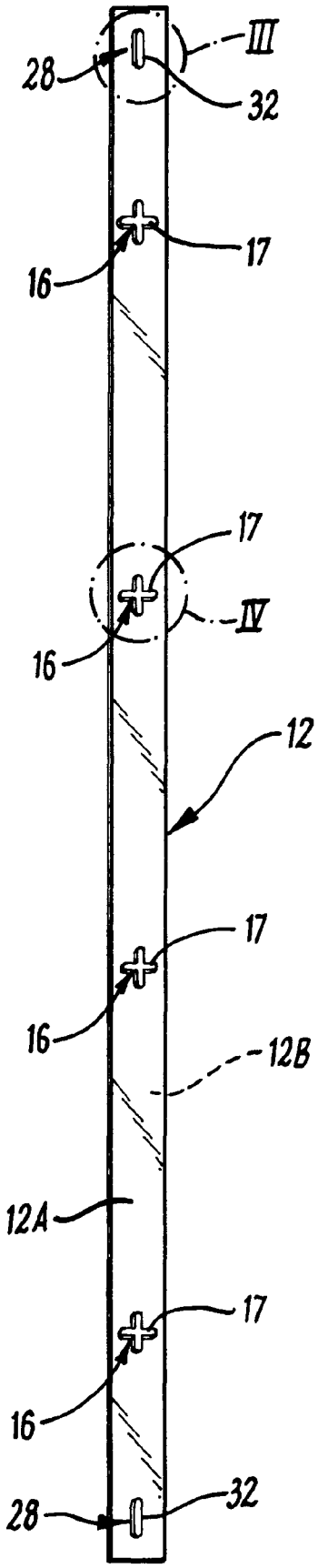
FIG. 2 is a top view of a first alignment member
Figure 3:
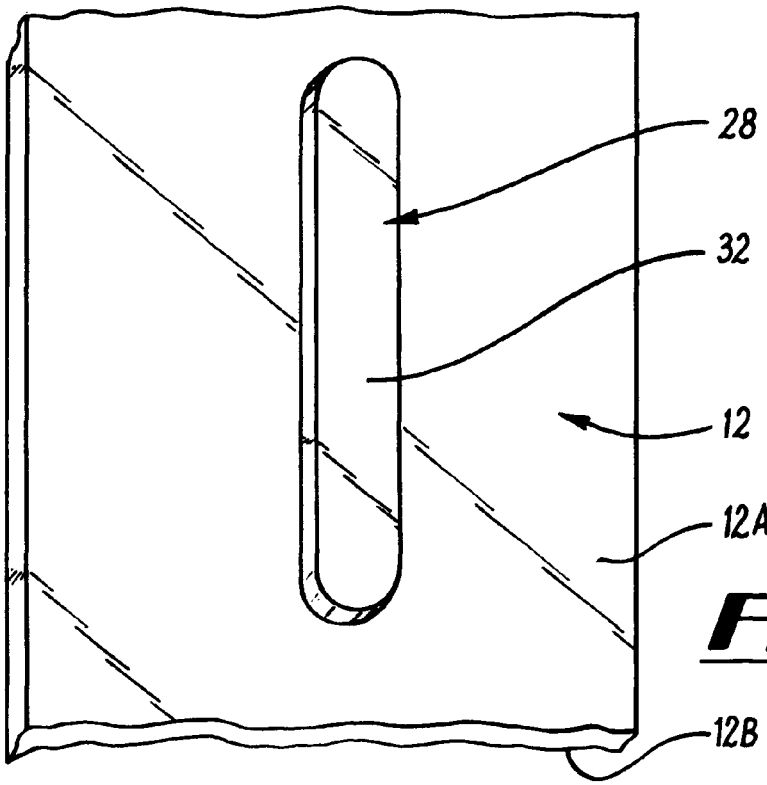
FIG. 3 is a top perspective view of the region marked III in FIG. 2.
Figure 5:
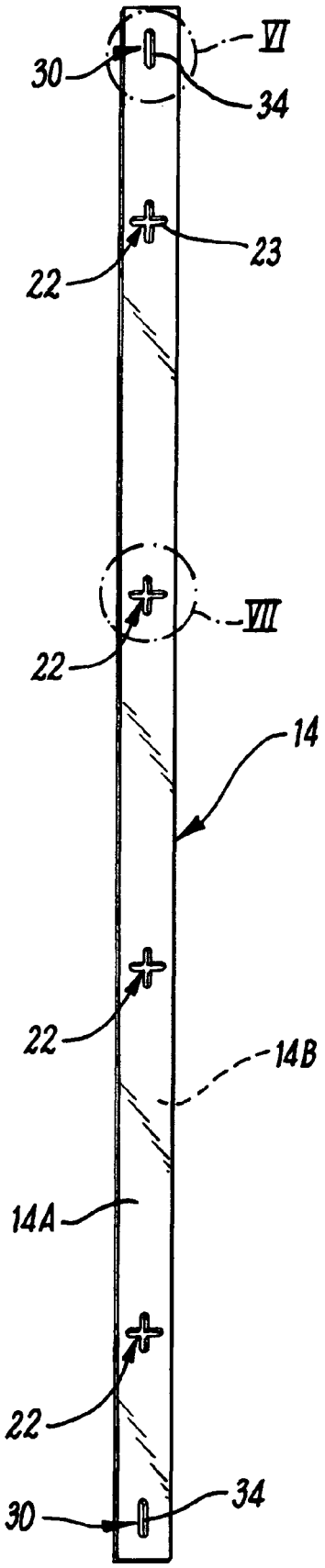
FIG. 5 is a top view of the second alignment member.
Figure 6:
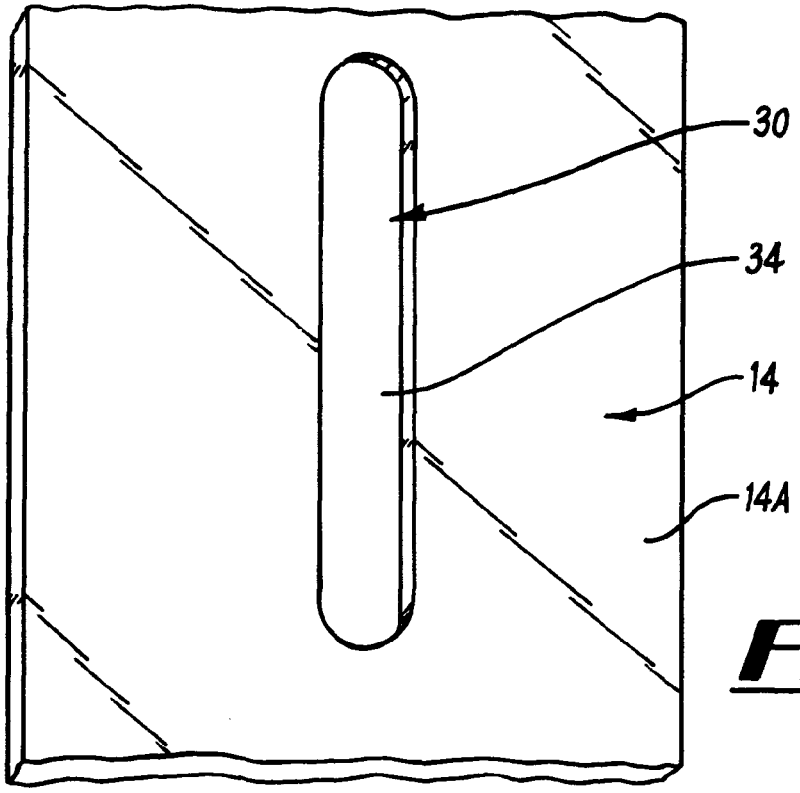
FIG. 6 is a top perspective view of the region marked VI in FIG. 5.
Figure 7:
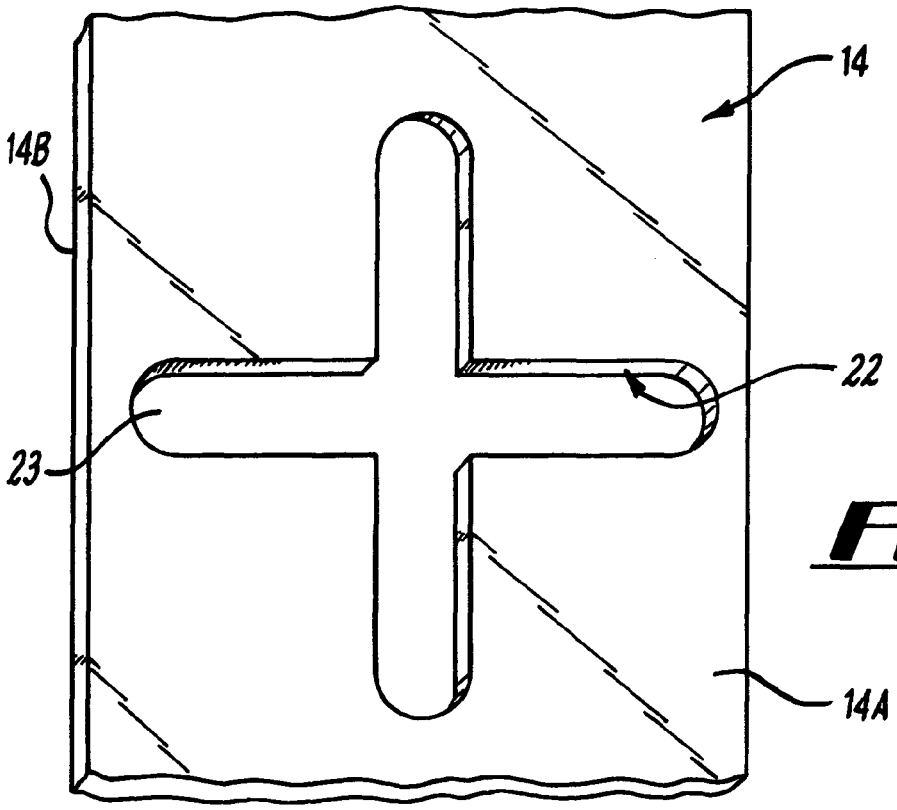
FIG. 7 is a top perspective view of the region marked VII in FIG. 5.

The lower faces 12B, 14B are designated in FIGS. 2 and 5 respectively with broken lines to indicate that the second faces 12B, 14B are on the reverse of the first and second alignment members.

Figure 4:
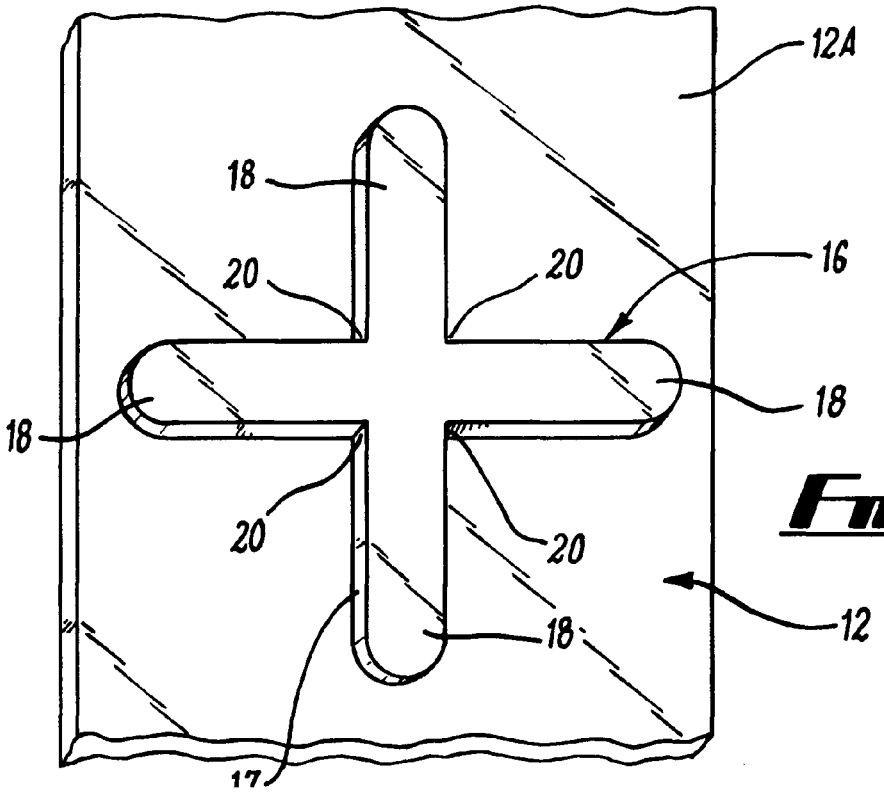
FIG. 4 is a top perspective view of the region marked IV in FIG. 2.

A plurality of first co-operating formations 16 are provided on each of the first alignment members 12. As shown in FIG. 4, each of the first co-operating formations 16 is in the form of a projecting cruciform member 17 having four arms 18 extending outwardly from one another at right angles to define four right angled corners 20.

All of the arms 18 are substantially the same as each other. Each first co-operating formation 16 extends upwardly from the upper flat face 12A of the respective first alignment member 12.

The first co-operating formations 16 constitute alignment formations to align the placement of tiles (not shown) on a surface to be tiled. This is described in more detail below.

A plurality of second co-operating formations 22 are provided on each of the second alignment members 14. The second co-operating formations 22 are in the form of cruciform apertures 23 defined in the second alignment members 14.

The cruciform apertures 23 extend through the second alignment member 14 from the upper generally flat face 14A to the second generally flat face 14B of each respective second alignment member 14.

The cruciform apertures 23 are of a corresponding size and shape to the cruciform members 17. Therefore, each cruciform aperture 23 can receive a respective cruciform member 17, such that the cruciform member 17 is a tight fit within the cruciform aperture 23, and is held therein.

The first and second co-operating formations 16, 22 are spaced from each other on the respective first and second alignment members 12, 14. The spacing between adjacent first co-operating formations 16 is constant and equal to the distance along one edge of a tile. Similarly, the spacing between adjacent second co-operating formations 22 is also constant and equal to the distance along one edge of a tile.

In order to secure the first and second alignment members together, the projecting cruciform members 17 are pushed into the cruciform apertures 23. The projecting cruciform members 17 are a tight fit within the cruciform apertures 23 and, therefore, are held therein.

Fixing means is provided to fix the first and second alignment members 12, 14 to the surface. The fixing means is in the form of, for example, a suitable adhesive, or double-sided adhesive tape, which is applied to the lower faces 12B, 14B of the first and second alignment members 12, 14.

In order to use the alignment apparatus 10, the first and second alignment members 12, 14 are first arranged in an interlocking grid 25, as shown in FIG. 1. This is done in by arranging the first alignment members 12 parallel to one other, and arranging the second alignment members 14 over the top of the first alignment members 12, such that the cruciform apertures 23 are aligned with the cruciform members 17.

The cruciform members 17 are then pushed into the cruciform apertures 23 to secure the first alignment members 12 to the second alignment members 14 to form the grid 25. The grid 25 can be attached to the surface to be tiled, for example a wall or floor by the use of the adhesive, or adhesive tape, on the lower faces 12B, 14B.

When the first and second alignment members 12, 14 are arranged into the form of a grid, as shown in FIG. 1, a plurality of square regions 26 are defined, with the cruciform members 17 and the cruciform apertures 23 at the corners of the square regions 26. Each region 26 is of an appropriate size and shape to receive a respective one of the tiles therein.

If desired, the regions 26 could be of a rectangular configuration by making the distance between adjacent cruciform members 17 different to the distance between adjacent cruciform apertures 23, thereby enabling the alignment apparatus to be used with rectangular tiles.

Since the distance between adjacent cruciform members 17 and between adjacent cruciform apertures 23 are roughly equal to the lengths of the edges of a square or rectangular tile to be used, the corners of each tile are received in the corners 20 of the cruciform members and abut against the cruciform members 17.

Thus, when the grid 25 is arranged on the surface to be tiled, the user is presented with a plurality of the square or rectangular regions 26 into which the tiles can be arranged and adhered to the surface.

The cruciform members 17 have a height which is less than the thickness of the tiles and therefore does not project above the upper surface of the tile. As a result, when the grouting is arranged between adjacent tiles, the alignment apparatus 10 cannot be seen.

If it is desired to tile a surface which is of a greater area than the area covered by the grid 25, a further grid 25A can be connected thereto, as shown in broken lines in FIG. 1. In order to connect a further grid 25A to the first mentioned grid 25, each of the first and second alignment members 12, 14 is provided with respective first and second connecting formations 28, 30.

The first connecting formations 28 are provided on the first alignment members 12, and comprise two elongate projecting members 32. The elongate projecting members 32 project upwardly from the upper face 12A of the first alignment members 12.

The elongate projecting members 32 are provided at respective opposite end regions of each of the first alignment members 12. The distance between the elongate projecting members 32 and the adjacent cruciform member 17 is equal to roughly half of the distance between adjacent cruciform members 17.

Figure 8:
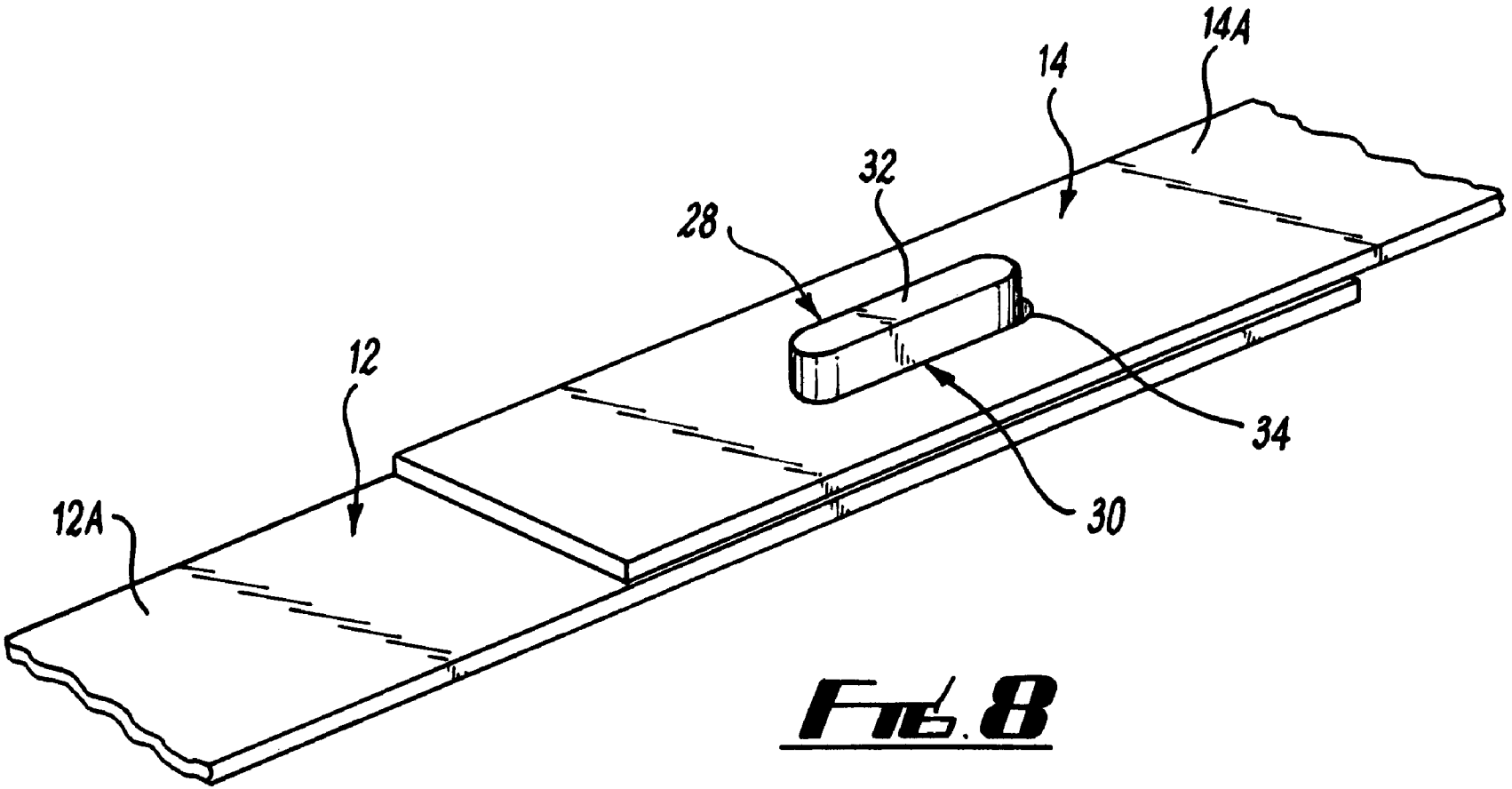
FIG. 8 is a perspective view showing the first end regions of first and second alignment members connected to each other.

The second connecting formations 30 are provided on the second alignment member 14 and are in the form of two elongate apertures 34. The elongate apertures 34 and the elongate projecting members 32 are of a suitable size, shape and orientation that the elongate projecting members 32 are received in the elongate apertures 34, and are a tight fit to therein, as shown in FIG. 8.

As a result, when the area of the alignment apparatus 10 is extended by the use of further grids 25A, the further grids 25A are arranged such that they are oriented at right angles to the grid or grids to which they are connected.

Thus, when a further grid 25A is connected to first mentioned grid 25, either (a) the first alignment members 12 of the further grid 25A are connected to the second alignment members 14 of the further grid 25A, or (b) the second alignment members 14 of the further grid 25A are connected to the first alignment members 12 of the first mentioned grid 25.

Various modifications can be made without departing from the scope of the invention.

For example, in a modification to the first embodiment described above, shown in FIGS. 9 and 10, the first co-operating formations 16 are in the form of first projecting cruciform members 40 which are similar to the first mentioned cruciform member 17 shown in FIG. 4, in that they include four right angled corners 20, between the arms 18, but differ in that the first projecting cruciform members 40 are smaller than the first mentioned cruciform members 17, which are shown in FIG. 4.

Referring back to FIGS. 9 and 10, the second co-operating formations 22 on the second alignment members 14 are in the form of second projecting cruciform members 42, which are of the same shape as the first projecting cruciform member 40, but are larger.

Each second projecting cruciform member 42 defines and cruciform aperture 44 therein to receive a respective one of the first projecting cruciform members 40.

In order to secure the first and second alignment members 12, 14 to each other, the first and second alignment members 12, 14, are arranged in a grid, similar to that shown in FIG. 1, and the first projecting cruciform members 40 are pushed into the cruciform apertures 44 of the second projecting cruciform members 42.

Figure 9:
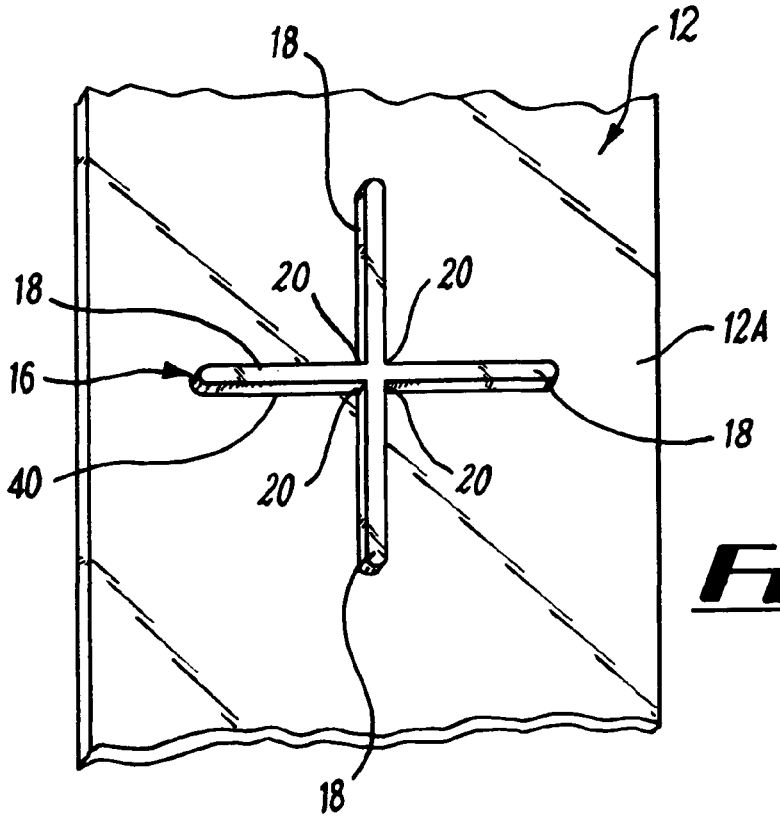
FIG. 9 is a top view of a first co-operating formation of a further embodiment.
Figure 9A:
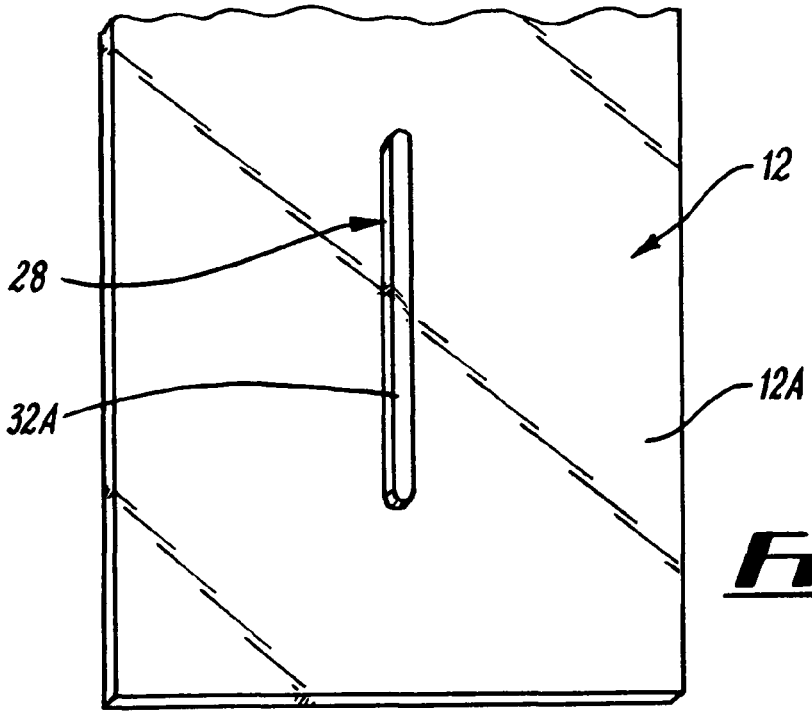
FIG. 9A is a top view of a first connecting formation of the further embodiment.
Figure 10:
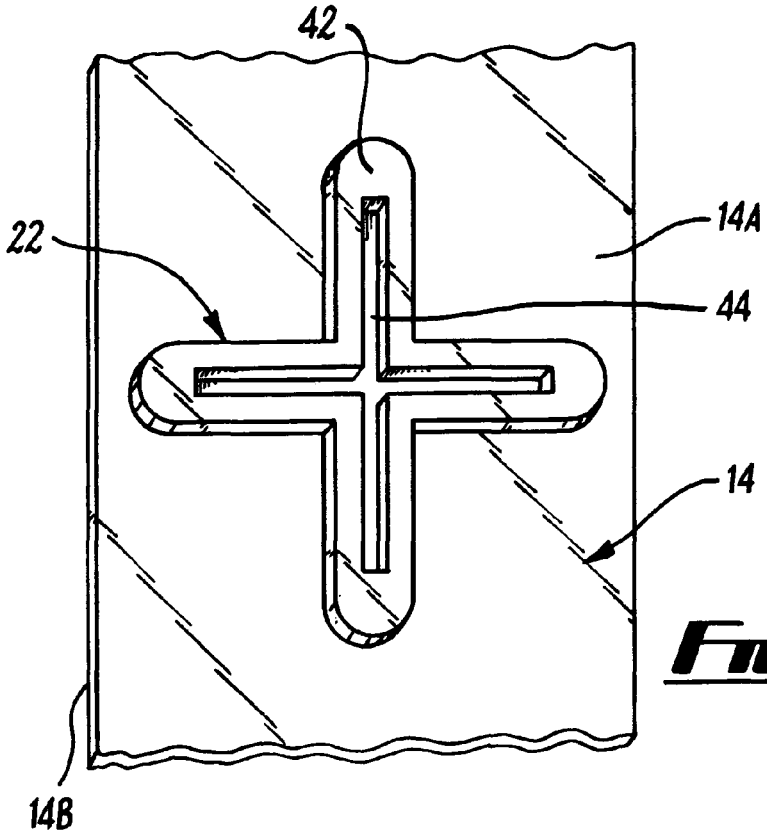
FIG. 10 is a top view of a first co-operating formation of the further embodiment.
Figure 10A:
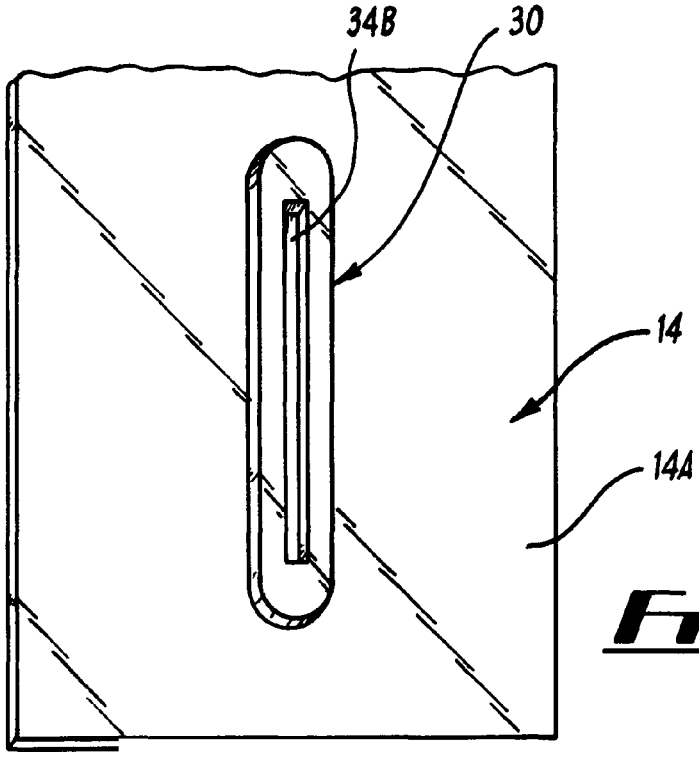
FIG. 10A is a top view of a second connecting formation of the further embodiment.

The second embodiment may include connecting formations which are similar to, or the same as, the connecting formations of the first embodiment. Alternatively, each first connecting formation 28 may be as shown in FIG. 9A, namely in the form of a first elongate longitudinally extending member 32A, and each second connecting formation 30 may be as shown in FIG. 10A, namely a second elongate longitudinally extending projection 34A defining a longitudinally extending recess 34B to receive a respective first longitudinally extending projection 32A.

Other than as described above, the features of the second embodiment are generally the same as the features of the first embodiment and, therefore, are not described in detail with reference to FIGS. 9 and 10.

Referring to FIGS. 11A to 11F, there are shown two different arrangements of the alignment apparatus 10, as applied to an area of a rectangular wall or floor having perpendicular sides 50, 52.

Figure 11A:
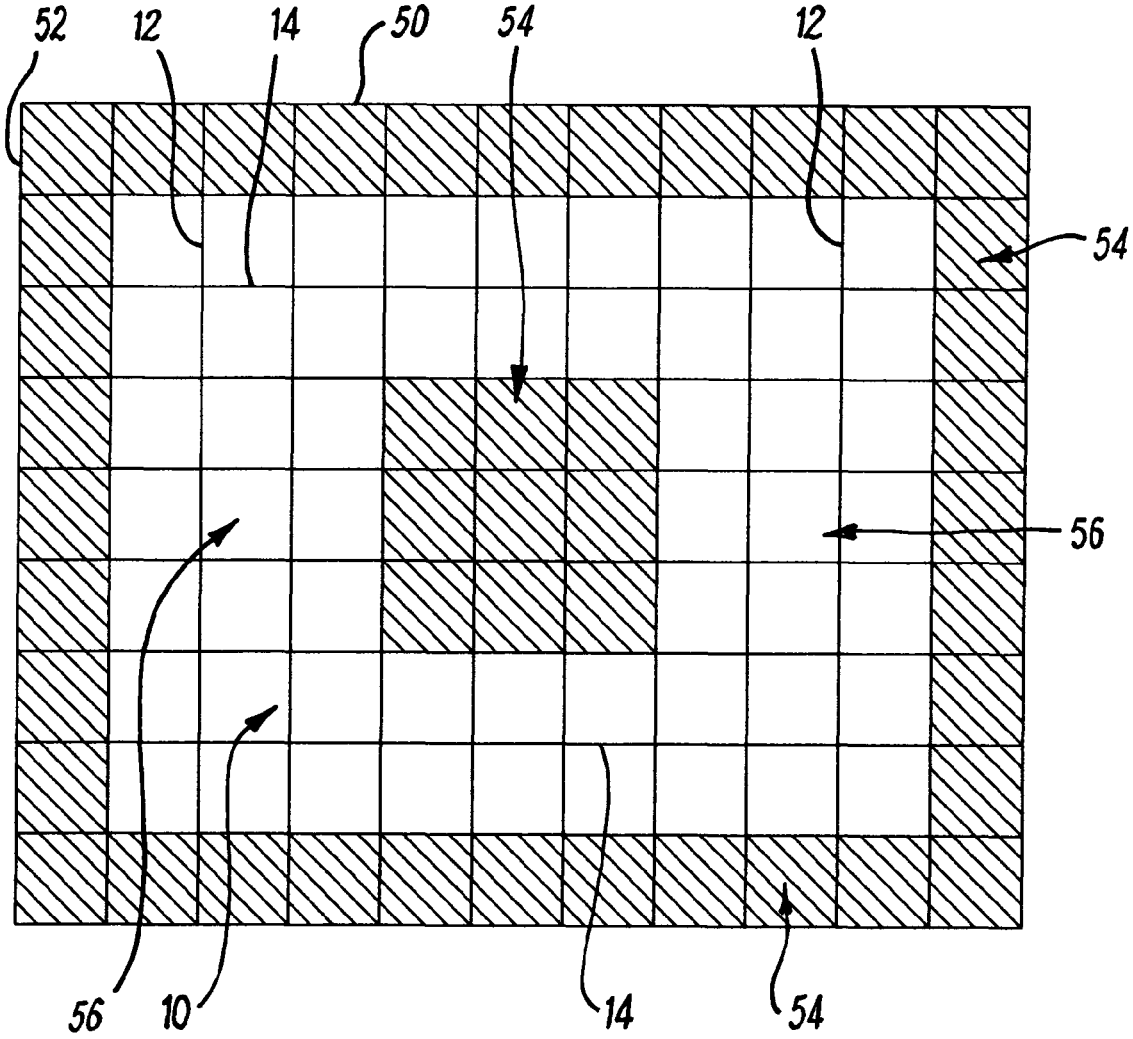
FIGS. 11A to 11F are top plan views of the alignment apparatus in grid form, showing possible arrangements of articles.
Figure 11B:
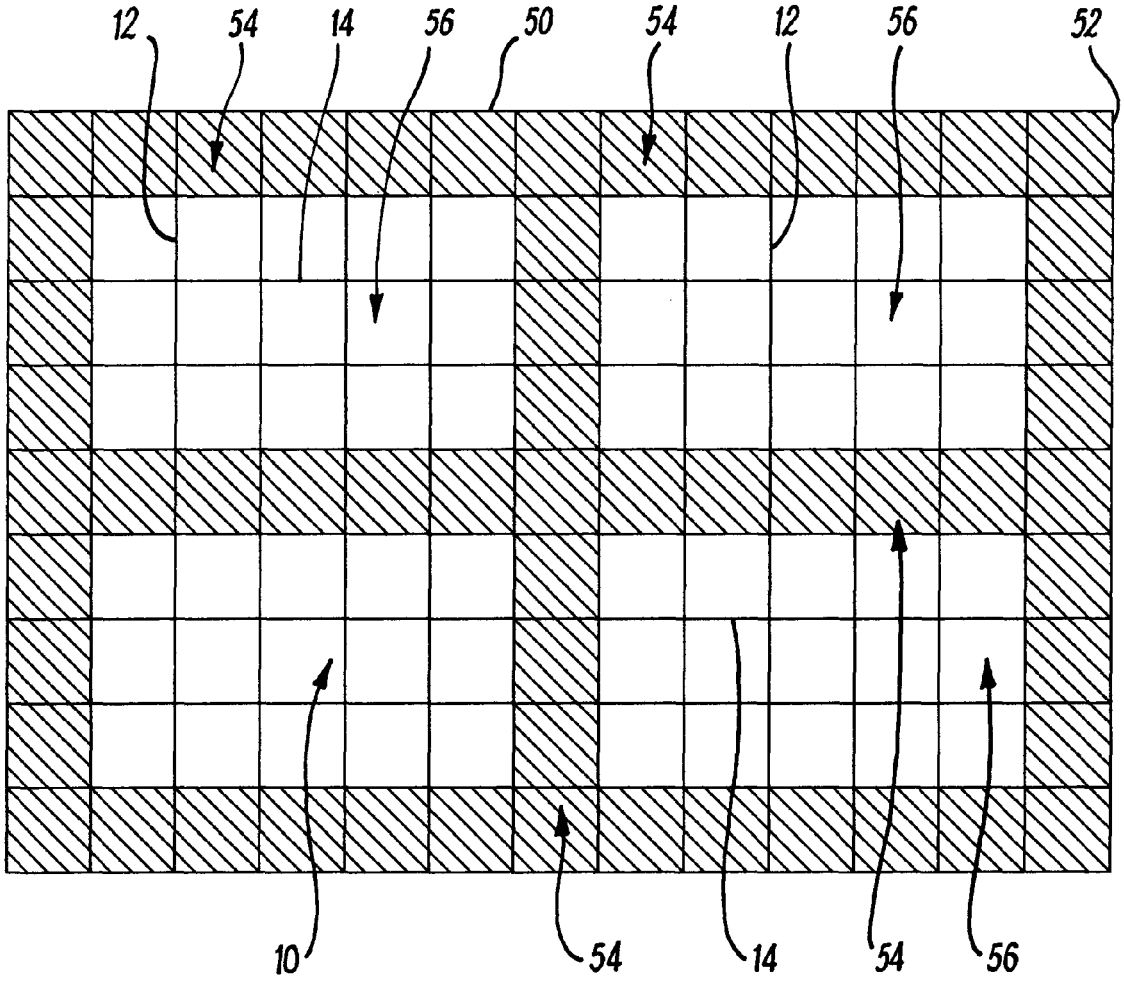
Figure 11C:
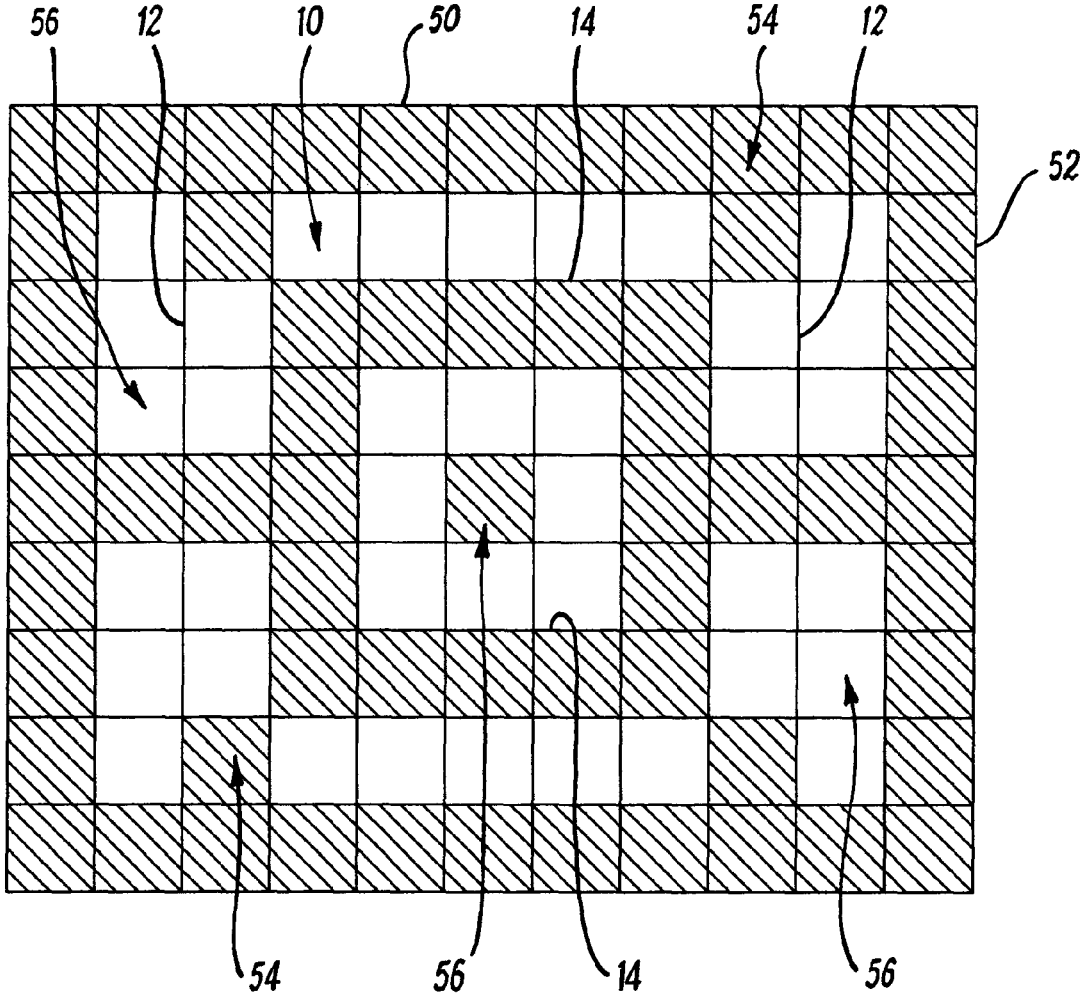

In FIGS. 11A to 11C, the alignment apparatus 10 is arranged such that the first and second alignment members 12, 14 are parallel to the sides 50, 52.

Figure 11D:
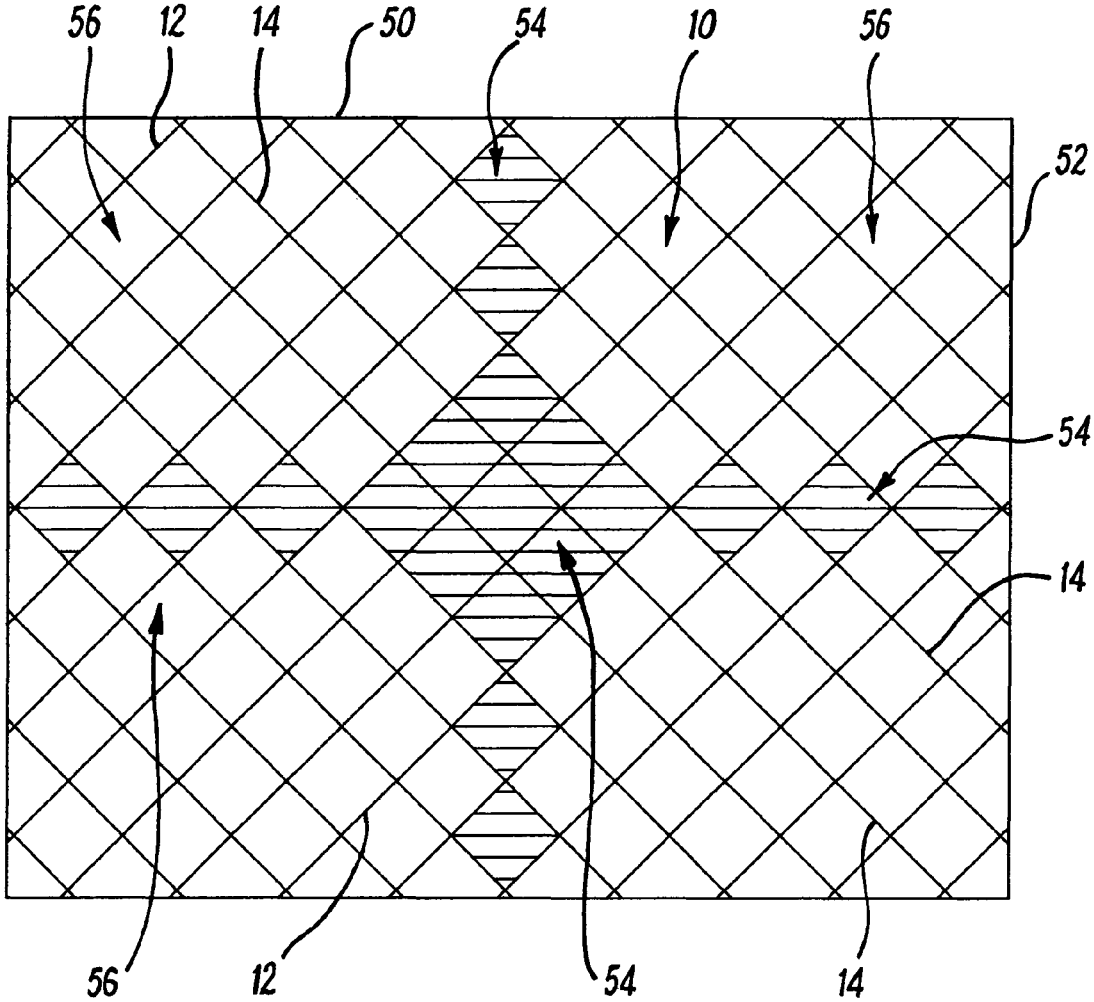
Figure 11E:
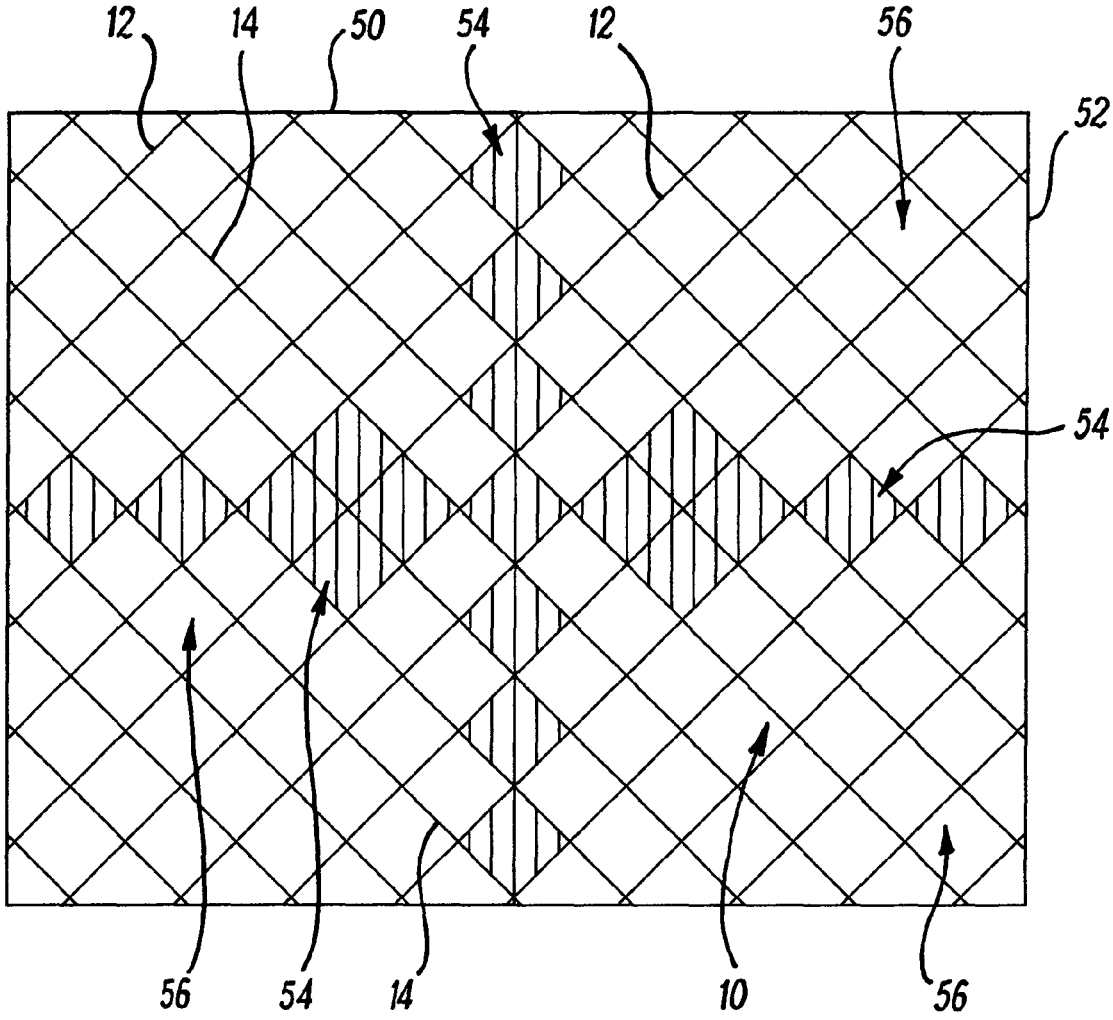
Figure 11F:
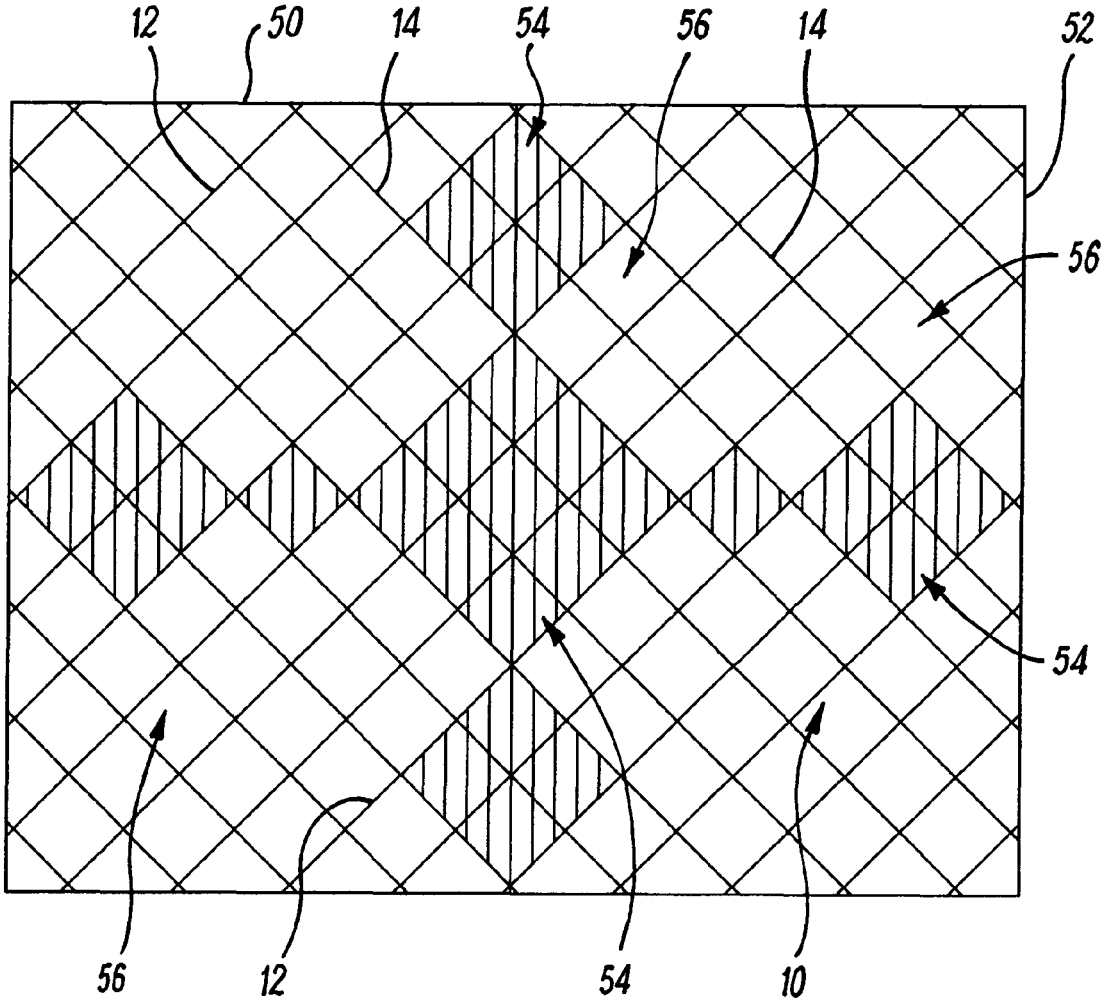

In FIGS. 11D to 11F, the first and second alignment members 12, 14 are arranged at an angle of substantially 45° to the sides 50, 52, thereby providing a diamond pattern.

An alternative to the first embodiment of the alignment apparatus 10 is shown in FIGS. 12 to 16, which comprises many of the features shown in FIGS. 1 to 10 above, and these features have been designated with the same reference numerals as in FIGS. 1 to 10 above.

The features of FIGS. 12 to 16 which correspond to features in FIGS. 1 to 10 are not described in detail in this part of the specification, because they would be understood by those skilled in the art.

Figure 12:
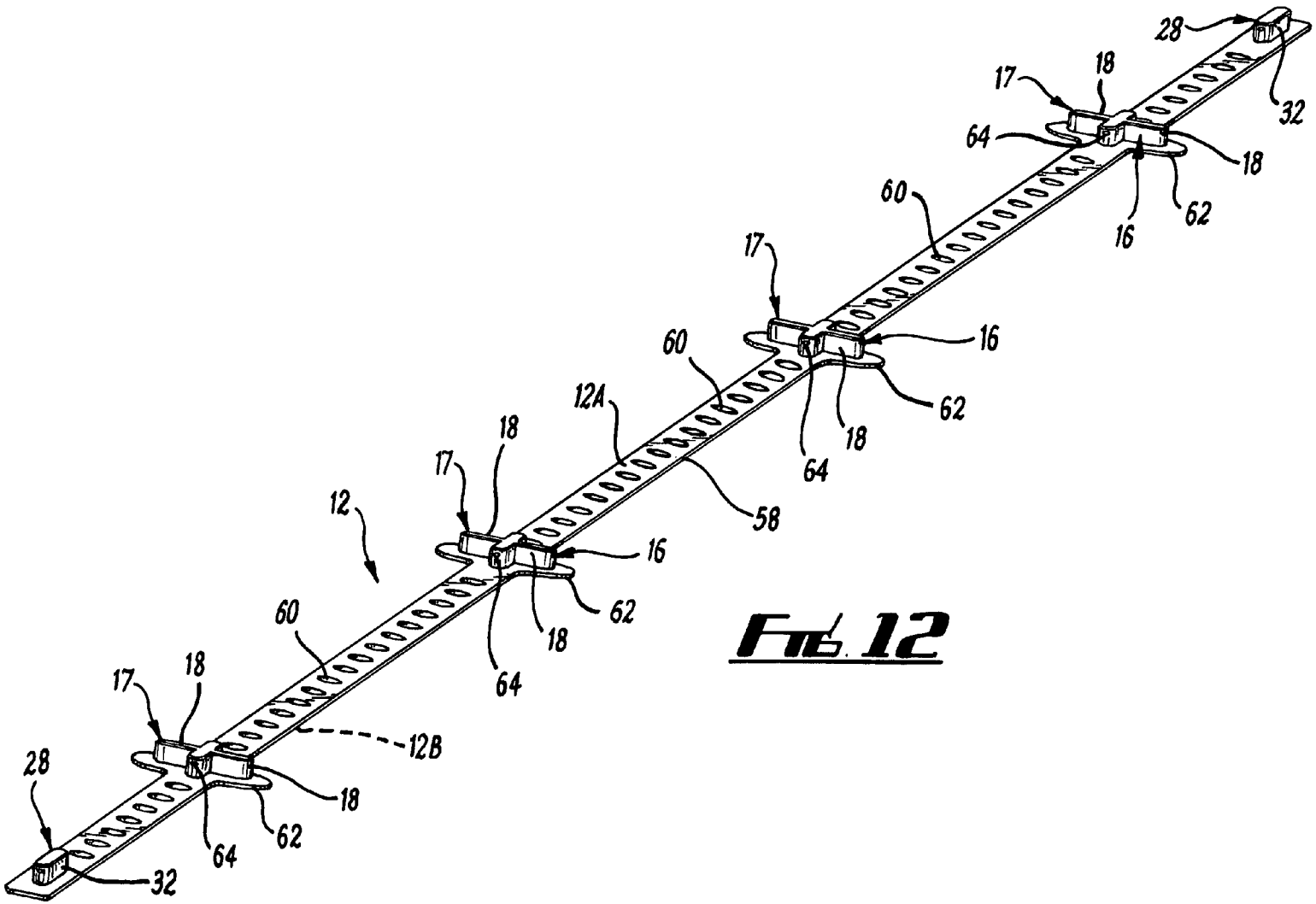
FIG. 12 is a perspective view of a first alignment member of another alignment apparatus.

The alignment apparatus 10 as shown in FIGS. 12 to 16 differs from the embodiment shown in FIGS. 1 to 10 in that the first and second alignment members 12, 14 are narrower in width than first and second alignment members 12, 14 of the embodiments shown in FIGS. 1 to 10. The first alignment member 12, as shown in FIG. 12 comprises an elongate main part 58, which defines a plurality of holes 60 extending one after the other along the main part 58.

The first alignment member 12 shown in FIG. 12 comprises a plurality of support formations 62 substantially uniformly spaced along the elongate main part 58 of the first alignment member 12. The support formations 62 extend outwardly from the elongate main part 58 and are oval in shape.

The support formations 62 are provided to support the first co-operating formations 16, each of which extends upwardly from a respective one of the support formations 62.

The first co-operating formations 16 are in the form of cruciform members 17, having four arms 18. Each of the arms 18 of the cruciform members 17 has a detent formation 64, in the form of a hemispherical projection. The detent formations 64 are provided to hold the second alignment members 14 on the first alignment members 12, as explained in more detail below with reference to FIG. 16.

Figure 13:
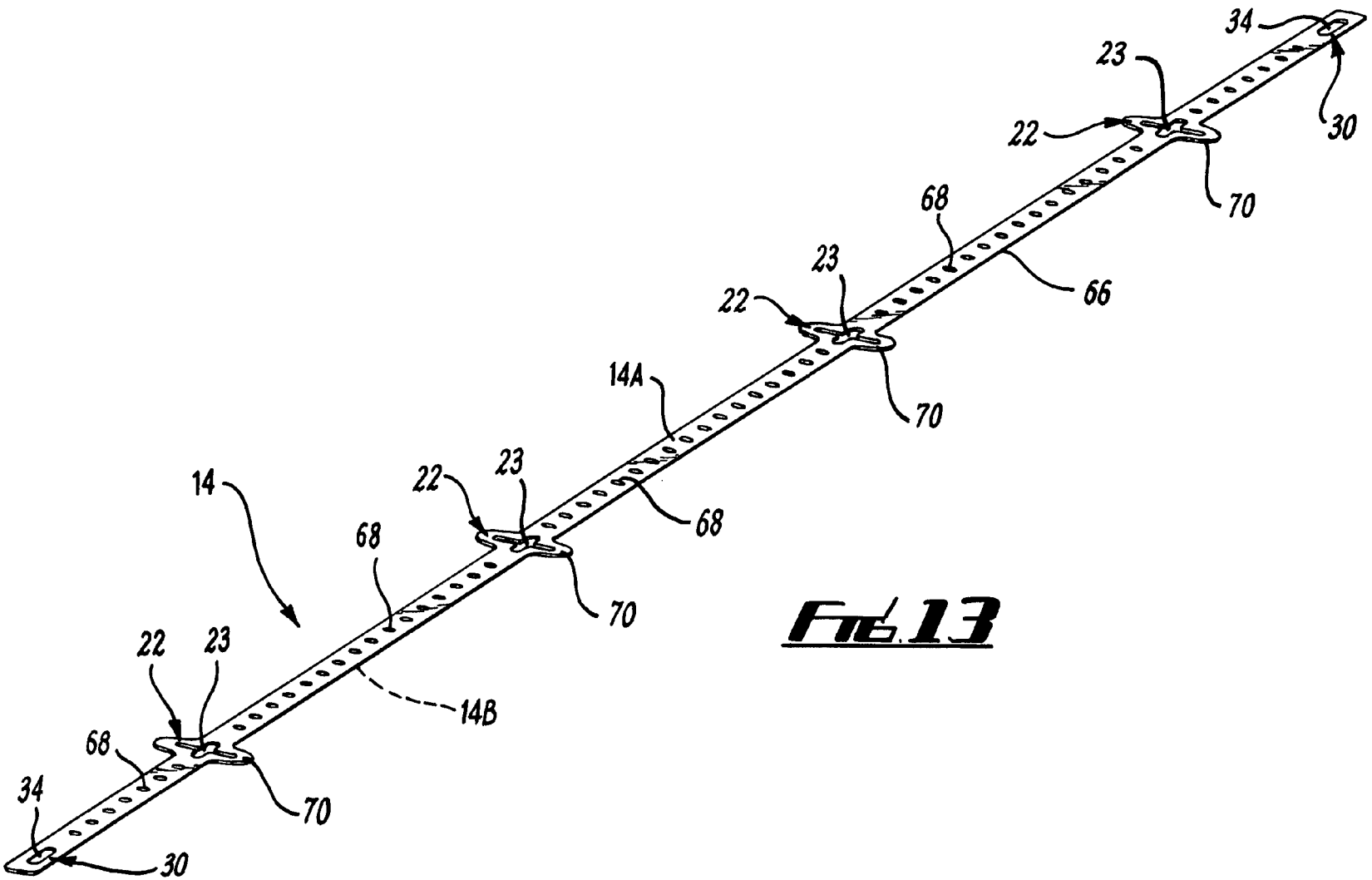
FIG. 13 is a perspective view of a second alignment member of said other embodiment.

Referring to FIG. 13, there is shown the second alignment member 14 of the third embodiment. The second alignment member 14 comprises an elongate main portion 66 which defines a plurality of holes 68 extending one after the other along the main portion 66.

The second alignment member 14 shown in FIG. 13 also includes a plurality of receiving formations 70 substantially uniformly spaced along the main portion 66. The receiving portions 70 define the cruciform apertures 23, as shown. The receiving formations 70 are substantially oval in shape, and extend outwardly from the main portion 66. The receiving formations 70 lie in the same plane as the main portion 66.

Thus, the cruciform apertures 23 in the receiving formations 70 in the second alignment member 14 can receive the cruciform members 17 on the first alignment member 12. This feature allows a grid to be formed to guide the alignment of tiles, in a similar manner to that explained above.

Figure 14:
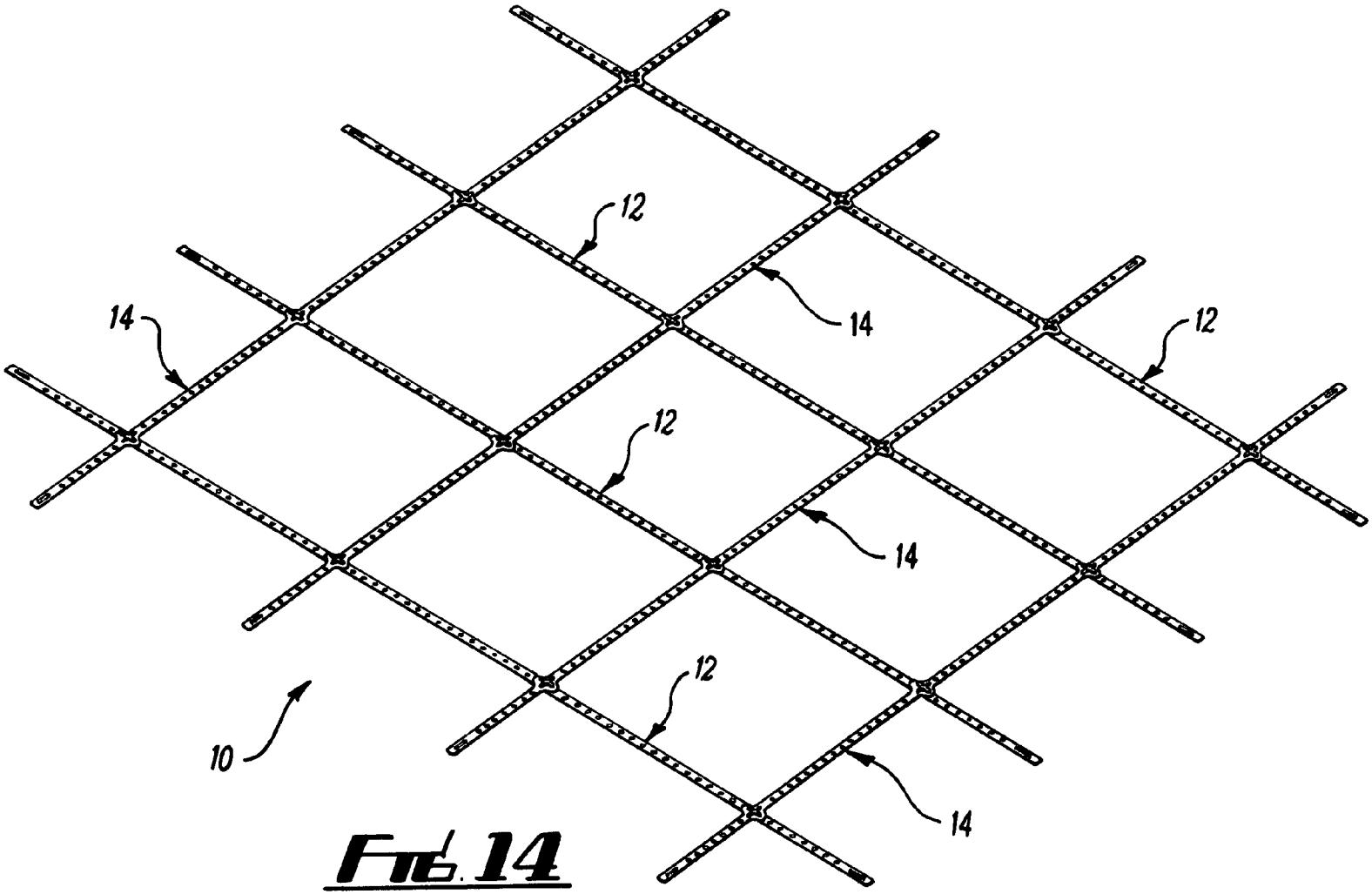
FIG. 14 is a view of said other embodiment of the alignment apparatus in grid form.

Referring to FIG. 14, the alignment apparatus 10 is shown in the form of the grid, which allows tiles to be aligned during the tiling process. As can be seen, the first alignment members 12 are connected to the second alignment members 14 by the co-operation of the first and second co-operating formations 16, 22, whereby the cruciform members 17 are received in the cruciform apertures 23.

If it is desired to apply the alignment apparatus to an area larger than the area occupied by the grid shown in FIG. 14, it is necessary to extend the length of the first and/or second alignment members 12, 14. This can be effected by connecting the first alignment members 12 to the second alignment members 14 in line with one another as shown in more detail in FIG. 15.

Figure 15:
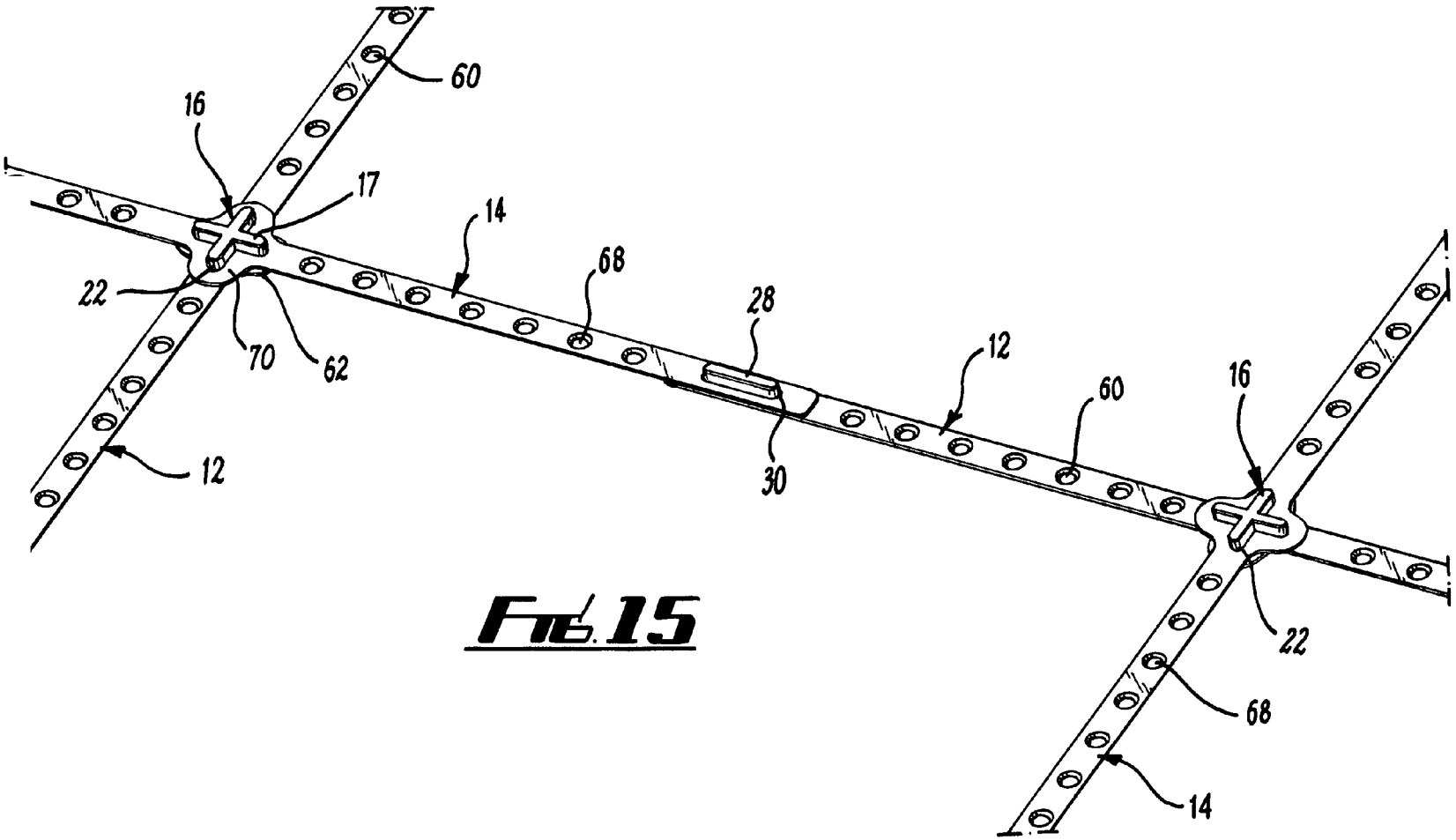
FIG. 15 shows the connection of a first alignment member to a second alignment member in line with each other.

As can be seen from FIG. 15, the first alignment member 12 is connected to the second connecting member 14 by the first and second connecting formations 28, 30. This is repeated as desired, until the required area is covered by the alignment apparatus 10.

Figure 16:
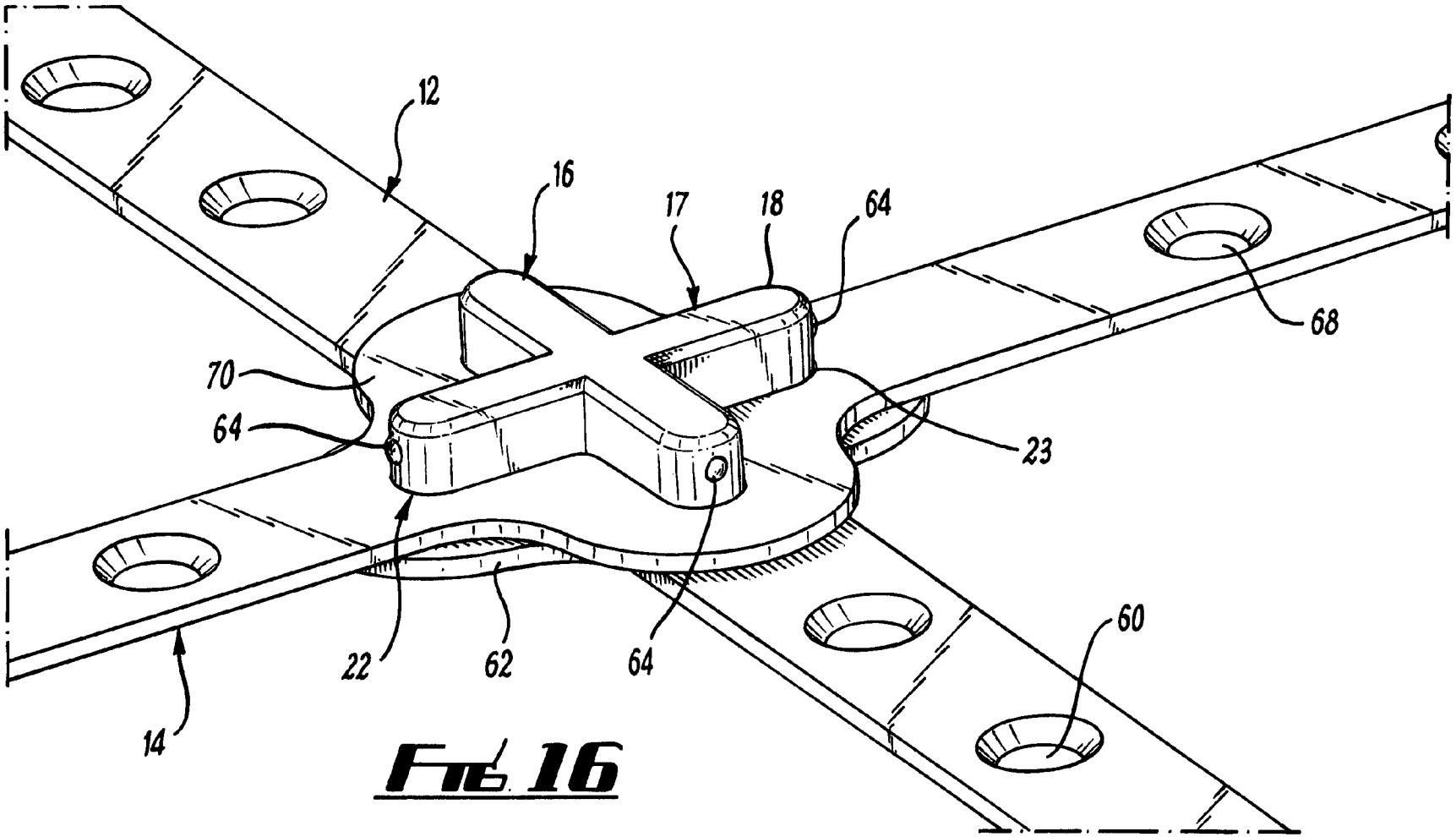
FIG. 16 is a close up view of the first and second co-operating formations of said other embodiment.
Figure 17:
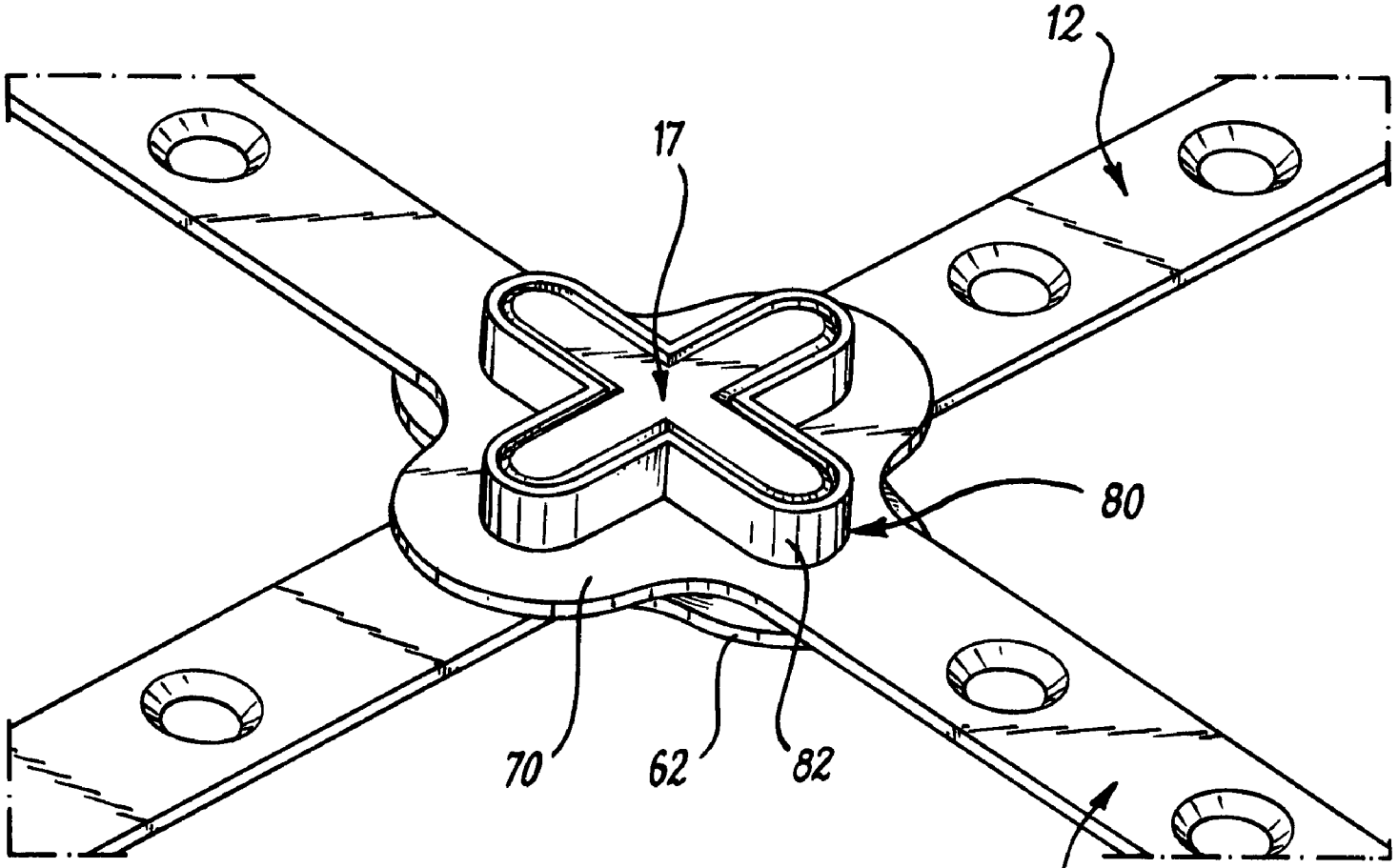
FIG. 17 is a view of the first and second co-operating formations with an accommodation member.
Figure 18:
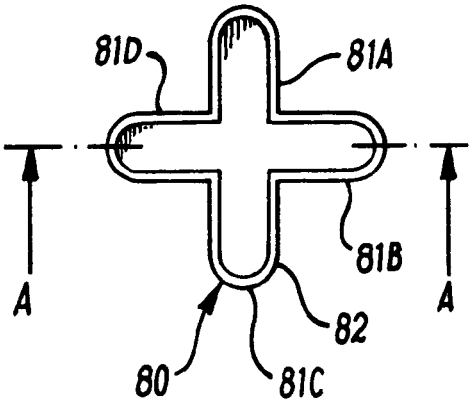
FIG. 18 is a top plan view of an accommodation member.
Figure 19:
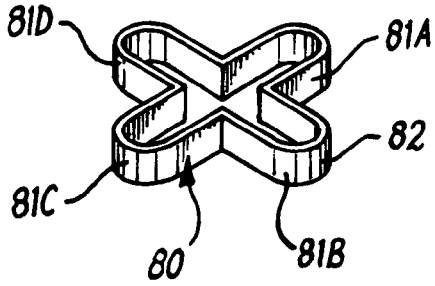
FIG. 19 is a perspective view of an accommodation member.
Figure 20:
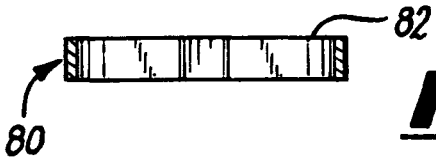
FIG. 20 is a view along the lines A-A in FIG. 18.
Figure 21:
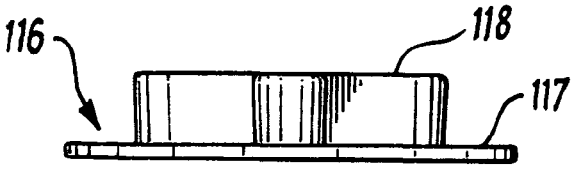
FIG. 21 is a side view of a separate first co-operating formation.
Figure 22:
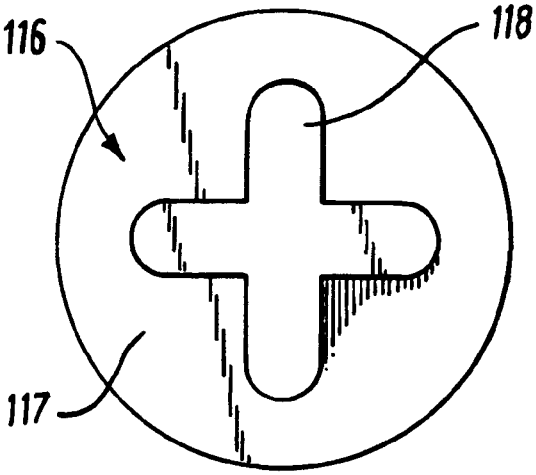
FIG. 22 is a top view of the first co-operating formation shown in FIG. 21.

FIG. 16 shows a close-up of the first and second securing formations 16, 22 in co-operation with each other. The cruciform member 17 extends through the cruciform aperture 23 to secure the first alignment member 12 to the second alignment member 14.

As mentioned above, each of the arms 18 of the cruciform member 17 is provided at its free end with one of the detent formations 64. The detent formations 64 are provided to prevent inadvertent removal of the cruciform member 17 from the cruciform aperture 23.

FIGS. 17 to 20 show a further feature of the alignment apparatus which can allow for variations in actual tile size between tiles having the same nominal size. It can be the case that different tile manufacturers manufacture tiles which nominally have the same size as each other, but the tile of one manufacturer can differ in size from the tiles of another manufacturer by several millimetres.

In order to accommodate these variations, the distance between adjacent first co-operating formations 16 on the first alignment members 12 corresponds to the actual size of the largest tile for a particular nominal size. In order to accommodate tiles of smaller actual size, sleeves 80 are provided.

The sleeves 80 are received over the cruciform members 17. The sleeves 80 are of the same cruciform shape as the cruciform members 17, having four arms 81A, 81B, 81C and 81D. The sleeves 80 are a tight fit on the cruciform members 17.

The sleeves 80 have an outer wall 82, which has a thickness to fit the actual size of a particular tile. It will be appreciated that a plurality of sleeves 80 can be provided, having different thicknesses of the outer wall 82, but each having the same internal size to be a tight fit on the cruciform members 17.

Thus, by the use of sleeves 80 of the appropriate wall thickness, tiles of the same nominal size, but of varying actual size can be accommodated by the same alignment apparatus 10.

One advantage of the above described embodiments is that when the first and second alignment members 12, 14 are secured together by means of the first and second co-operating formations 16, 22 a rigid, uniform array is provided on to which the tiles or slabs can be affixed.

The above described embodiments of the alignment apparatus obviate the problems of (a) trying to keep the tiles in uniform straight lines, and (b) trying to keep constant horizontal and vertical spacing between adjacent tiles. When grout is applied to the spaces between adjacent tiles, a neat, aesthetically pleasing finish is obtained. Moreover, the above described embodiments of the alignment apparatus allow the user to lay the tiles at a much faster rate.

In addition, the above described embodiments allow the user to apply the alignment apparatus 10 to the whole of the floor (or wall or ceiling) area and lay a pattern of, for example, a desired colour of tiles 54 (shown with hatching in FIGS. 11A to 11F). Examples of the patterns are shown in FIGS. 11A to 11F. Different coloured tiles 56 can then be laid around the pattern 52 to complete the tiling.

A still further embodiment is shown in FIGS. 21 to 24. In this embodiment, the alignment apparatus 10 comprises a plurality of only one type of elongate alignment member, each of which is the same as the second alignment members 14 shown in FIG. 13. Since the alignment member used with the embodiment shown in FIGS. 21 to 24 is the same as the second alignment member 14, the description of this embodiment will be made with reference to FIGS. 21 to 24 and FIG. 13.

The embodiment shown in FIGS. 21 to 24 comprises a plurality of first co-operating formations in the form of plugs 116, which comprise a base portion 117, which may be generally flat, and an upwardly extending cruciform projection 118. The cruciform projection is generally the same as the cruciform members 17.

In use, the alignment members 14 are connected to one another in an interlocking grid formation with the cruciform apertures 23 of the overlying alignment members 14 aligned with one another. The user arranges the plugs 117 to secure overlapping alignment members 114 to one another. The cruciform projections 118 are pushed through the aligned cruciform apertures 23, thereby securing the overlapping alignment members 14 together.

Figure 23:
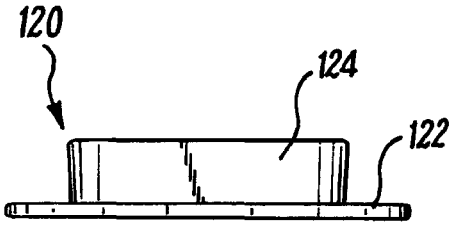
FIG. 23 is a side view of a separate first connecting formation.
Figure 24:
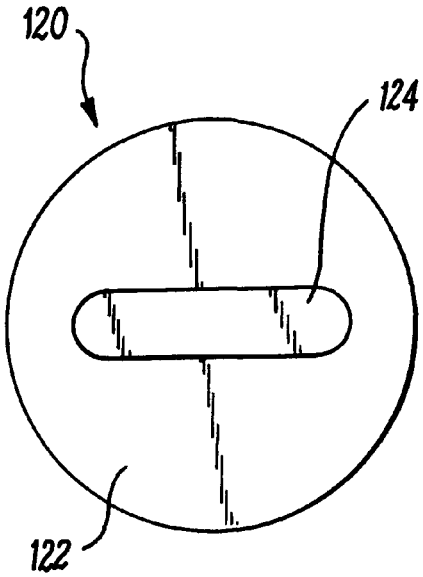
FIG. 24 is a top view of the first connecting formation shown in FIG. 23.

FIGS. 23 and 24 show first connecting formations in the form of a connecting plug 120, comprising a base part 122 and a connecting projection 124 extending upwardly from the base part 122. As can be seen, the connecting projection 124 is elongate.

Referring again to FIG. 13, the alignment members 14 define a second connecting formation 30 in the form of an elongate aperture or slot 34. In order to connect the alignment members 14 to one another longitudinally of each other, axially adjacent alignment members 14 are arranged such that their adjacent end regions overlie each other with the slots 34 aligned with each other.

In this position, one of the connecting plugs 120 is arranged such that the connecting projection 124 is inserted through the aligned slots 34 to secure the alignment members 14 axially to each other. This allows the area covered by the interlocking grid formed by the alignment members 14 to be extended.

Figure 26:
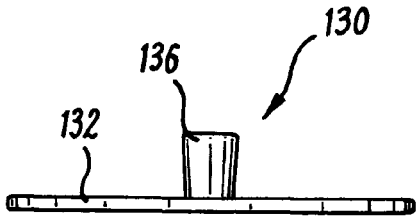
FIG. 26 is a side view of a further embodiment of a first connecting formation.
Figure 27:
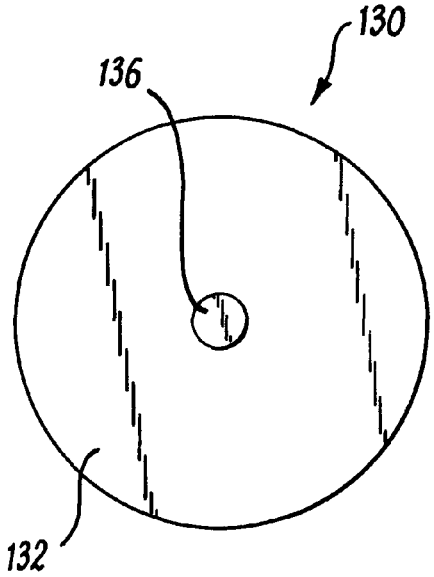
FIG. 27 is a top view of the first connecting formation shown in FIG. 26.
Figure 25:
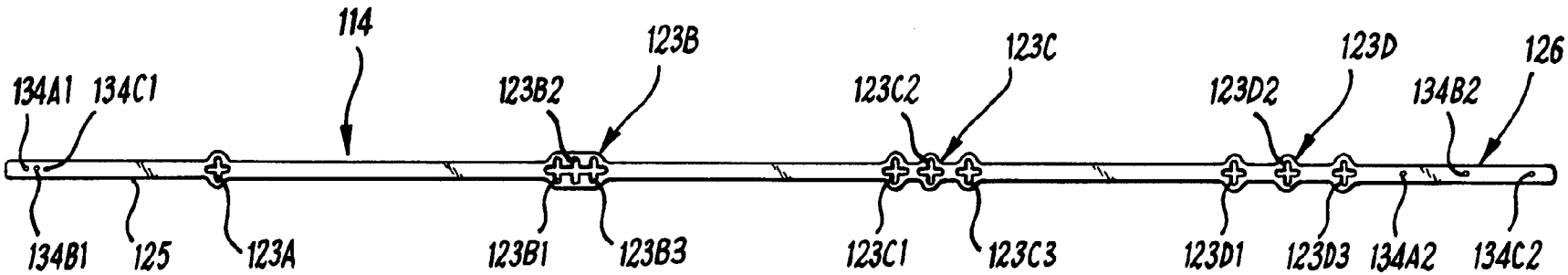
FIG. 25 is a top view of an alignment member of a further embodiment.

Yet another embodiment is shown in FIGS. 25 to 27. The embodiment shown in FIGS. 25 to 27 is similar to the embodiment shown in FIGS. 21 to 24 in that the embodiment shown in FIGS. 25 to 27 uses first co-operating formations in the form of the plugs 116, but the alignment members 14 are replaced by alignment members 114, shown in FIG. 25.

The alignment members 114 shown in FIG. 25 differ from the alignment members 14 shown in FIG. 13, in that the alignment member 114 comprises cruciform apertures 123 that are not uniformly spaced from one another. Instead the cruciform apertures are spaced from one another by distances that correspond to the lengths of the sides of different sized tiles.

In FIG. 25, the alignment member 114 comprises a single cruciform aperture 123A at one end region 124 of the alignment member 114. Spaced from the single cruciform aperture 123A along the alignment member 114, there is provided a first set 123B of three cruciform apertures designated respectively 123B1, 123B2 and 123B3.

The distance from the single cruciform aperture 123A to the closest cruciform aperture 123B1 of the first set 123B is equal to the length of the side of the smallest tile which is intended to be used with the embodiment of the apparatus 10 shown in FIGS. 25 to 27.

The distance from the single cruciform aperture 123A to the middle cruciform aperture 123B2 of the first set 123B is equal to the length of the side of the intermediate sized tile which is intended to be used with the embodiment of the apparatus 10 shown in FIGS. 25 to 27.

Similarly, the distance from the single cruciform aperture 123A to the furthest, cruciform aperture 123B3 of the first set 123B is equal to the length of the side of the largest tile which is intended to be used with the embodiment of the apparatus 10 shown in FIGS. 25 to 27.

Spaced from the first set 123B of cruciform apertures along the alignment member 114, there is provided a second set 123C of three cruciform apertures designated respectively 123C1, 123C2 and 123C3.

The distance from the cruciform aperture 123B1 of the first set 123B to the closest cruciform aperture 123C1 of the second set 123C is again equal to the length of the side of the smallest tile which is intended to be used with the embodiment of the apparatus 10 shown in FIGS. 25 to 27.

The distance from the middle cruciform aperture 123B2 of the first set 123B to the middle cruciform aperture 123C2 of the second set 123B is equal to the length of the side of the intermediate sized tile which is intended to be used with the embodiment of the apparatus 10 shown in FIGS. 25 to 27.

Similarly, the distance from the furthest cruciform aperture 123B3 to the furthest cruciform aperture 123C3 of the second set 123C is equal to the length of the side of the largest tile which is intended to be used with the embodiment of the apparatus 10 shown in FIGS. 25 to 27.

Finally, there is a third set 123D of cruciform apertures towards the other end region 126, spaced from the second set 123C. The third set 123D comprises three cruciform apertures designated respectively 123D1, 123D2, 123D3.

The distance from the cruciform aperture 123C1 of the second set 123C to the closest cruciform aperture 123D1 of the third set 123D is again equal to the length of the side of the smallest tile which is intended to be used with the embodiment of the apparatus 10 shown in FIGS. 25 to 27.

The distance from the middle cruciform aperture 123C2 of the second set 123C to the middle cruciform aperture 123D2 of the third set 123B is equal to the length of the side of the intermediate sized tile which is intended to be used with the embodiment of the apparatus 10 shown in FIGS. 25 to 27.

The distance from the furthest cruciform aperture 123C3 of the second set 123C to the furthest cruciform aperture 123D3 of the third set 123D is equal to the length of the side of the largest tile which is intended to be used with the embodiment of the apparatus 10 shown in FIGS. 25 to 27.

Thus, once the user has decided upon the size of the tile he wishes to buy, the user then has to select which of the cruciform apertures 123 correspond to the length of the tile he has purchased, and then insert the plugs 116 through the cruciform apertures selected so that the alignment members 114 overlie, and are secured to, one another at the selected cruciform apertures 123.

If it is desired to extend the area covered by the interlocking grid of the alignment members 114, further alignment members can be attached in an axially extending relationship to the end regions of the alignment members 114 in the grid. For this purpose, both ends of each alignment member 114 are provided with second connecting formations 28 in the form of circular holes 134.

As can be seen from FIG. 25, the end region 125 is provided with three connecting holes 134A1, 134B1, and 134C1. The distance from the first connecting hole 134A1 to the single cruciform aperture 123A is equal to substantially half the distance between the single cruciform aperture 123A and the closest cruciform aperture 123B1 of the first set 123B.

The distance between the second connecting hole 134B1 and the single cruciform aperture 123A is equal to substantially half the distance between the single cruciform aperture 123A and the middle cruciform aperture 123B2 of the second set 123B.

The distance between the third connecting hole 134C1 and the single cruciform aperture 123A is equal to substantially half the distance between the single cruciform aperture 123A and the furthest cruciform aperture 123B3 of the second set 123B.

The opposite end region 126 is provided with fourth, fifth and sixth connecting holes designated 134A2, 134B2 and 134C2 respectively. The distance between the connecting aperture 123D1 of the third set 123D and the fourth connecting hole 134A2 is substantially equal to the distance between the first connecting hole 134A1 and the single cruciform aperture 123A.

Similarly, the distance between the middle connecting aperture 123D2 of the third set 123D and the fifth connecting hole 134B2 is substantially equal to the distance between the second connecting hole 134B1 and the single cruciform aperture 123A.

Finally, the distance between the connecting aperture 123D3 of the third set 123D and the sixth connecting hole 134C2 is substantially equal to the distance between the third connecting hole 134C1 and the single cruciform aperture 123A.

In order to connect the alignment members 114 together axially of one another, a first connecting formation in the form of a connecting plug 130 is provided. The connecting plug 130 comprises a substantially circular base 132 and an upstanding projection 136.

As can be seen from FIGS. 26 and 27, the upstanding projection 136 has a circular profile, enabling it to be inserted through the appropriate connecting holes 134.

In a further modification, the alignment apparatus can be constructed of a larger size and made more robust so that it is suitable for use during the laying of paving slabs on the ground, to align the paving slabs.

There are thus described, embodiments of a simple and effective alignment apparatus to assist in the tiling of walls, ceilings or floors, or to assist in the laying of paving slabs. The embodiments described above have the advantage that they allow correct positioning of tiles or slabs during the tiling or paving process.

The invention claimed is:

1. An alignment apparatus comprising a plurality of alignment members, and a plurality of first and second co-operating formations co-operable with one another to secure the alignment members to one another and to align the placement of a plurality of articles on a surface, wherein each first co-operating formation comprises a projection, and the second co-operating formations are in the form of apertures or recesses to receive a respective one of the projections and effect the aforesaid securing of the first and second alignment members to one another, characterized in that the first co-operating formations are separate from the alignment members, and the second co-operating formations are configured such that the alignment members can overlie one another, with the second co-operating formations of some of the alignment members being aligned with the second co-operating formations of others of the alignment members.

2. An alignment apparatus according to claim 1, wherein the first co-operating formations co-operate with the aligned second co-operating formations of the overlying alignment members to secure the overlying alignment members to one another.

3. An alignment apparatus according to claim 1, wherein the first co-operating formations comprise plug members, having a base portion and the projection extending from the base portion.

4. An alignment apparatus according to claim 3, wherein the projections are configured to be inserted through aligned second co-operating formations of overlying alignment members to secure the alignment members to one another.

5. An alignment apparatus according to claim 1, wherein the second co-operating formations are spaced from one another by distances that correspond to the lengths of the sides of different sized articles.

6. An alignment apparatus according to claim 5, wherein each alignment member comprises a plurality of sets of second co-operating formations spaced from each other set along the alignment member.

7. An alignment apparatus according to claim 6, wherein each set of second co-operating formations comprises a plurality of second co-operating formations, and the distance between the second co-operating formations progressively increases in successive sets along the alignment member.

8. An alignment apparatus according to claim 1, including first and second connecting formations to connect the alignment members axially to one another.

9. An alignment apparatus according to claim 8, wherein the second connecting formations are defined in the alignment members, at each respective opposite end region of the alignment members.

10. An alignment apparatus according to claim 8, wherein the first connecting formations are separate from the alignment members, and each alignment member has a respective second connecting formation at each end region of the alignment member.

11. An alignment apparatus according to claim 8, wherein each first connecting formation comprises an elongate connecting projection.

12. An alignment apparatus according to claim 11, wherein each second connecting formation comprises a connecting aperture or recess to receive the connecting projection.

13. An alignment apparatus according to claim 12, wherein each aperture or recess is elongate to receive an elongate connecting projection.

14. An alignment apparatus according to claim 11, wherein each first connecting formation comprises a plug element, having a base part and the connecting projection being on the base part.

15. An alignment apparatus according to claim 14, wherein the connecting projection is configured to be inserted through aligned second connecting formations of overlying alignment members to secure the alignment members to one another.

16. An alignment apparatus according to claim 1, wherein the second co-operating formations have a plurality of outwardly extending arms.

17. An alignment apparatus according to claim 16, wherein the second co-operating formations are in the form of a cruciform apertures, and the arms of the second co-operating formation are substantially the same as each other.

18. An alignment apparatus according to claims 16, wherein the second co-operating formations are right angled cruciform apertures which define right angled corners between adjacent arms of the cruciform apertures.

* * * * *